US011542056B2

(12) United States Patent
Jung et al.

(10) Patent No.: US 11,542,056 B2
(45) Date of Patent: Jan. 3, 2023

(54) ELECTRONIC DEVICE PACKAGING BOX

(71) Applicant: Samsung Electronics Co., Ltd., Suwon-si (KR)

(72) Inventors: Jihyun Jung, Suwon-si (KR); Kwangyoun Kim, Suwon-si (KR); Juyeoung Kim, Suwon-si (KR); Eunsu Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/044,038

(22) PCT Filed: Apr. 26, 2019

(86) PCT No.: PCT/KR2019/005092
§ 371 (c)(1),
(2) Date: Sep. 30, 2020

(87) PCT Pub. No.: WO2019/209077
PCT Pub. Date: Oct. 31, 2019

(65) Prior Publication Data

US 2021/0094725 A1 Apr. 1, 2021

(30) Foreign Application Priority Data

Apr. 27, 2018 (KR) ..... 10-2018-0049218

(51) Int. Cl.
*B65D 5/50* (2006.01)
*B65D 85/30* (2006.01)
(Continued)

(52) U.S. Cl.
CPC ..... *B65D 5/5028* (2013.01); *B65D 85/30* (2013.01); *H04R 1/026* (2013.01); *H04R 1/2811* (2013.01)

(58) Field of Classification Search
CPC .. B65D 5/5028; B65D 5/5035; B65D 5/5038; B65D 5/5286; B65D 81/127;
(Continued)

(56) References Cited

U.S. PATENT DOCUMENTS 969,087 A * 8/1910 carter ..... B65D 5/48048 229/120.34
2,783,013 A * 2/1957 Williamson ..... B65D 5/5206 248/450
(Continued)

FOREIGN PATENT DOCUMENTS

JP 06072430 A * 3/1994
JP 2012-037831 A 2/2012
(Continued)

*Primary Examiner* — J. Gregory Pickett
*Assistant Examiner* — Abigail Elizabeth Guidry
(74) *Attorney, Agent, or Firm* — Jefferson IP Law, LLP

(57) ABSTRACT

Various embodiments relating to a packaging box for packaging an electronic device are presented, and according to one embodiment, the packaging box comprises: a packaging box body; a receiving part included in the packaging box body and receiving the electronic device; and a support structure received in or removed from the receiving part, at least a portion of the supporting structure able to be slantedly folded to or unfolded, wherein the support structure in a folded state is received, together with the electronic device, in the receiving part to support the electronic device to be able to amplify a sound from a speaker included in the electronic device and, in a state removed from the receiving part or in a state received in the receiving part, the supporting structure cradles the electronic device, and additional various other embodiments are possible.

15 Claims, 32 Drawing Sheets

(51) Int. Cl.
*H04R 1/02* (2006.01)
*H04R 1/28* (2006.01)

(58) Field of Classification Search
CPC .... B65D 85/327; B65D 85/328; B65D 85/30; B65D 71/72; H04R 1/026; H04R 1/2811; H04R 1/028; F16M 11/2021; F16M 13/00; F16M 11/38; F16M 11/105; F16M 2200/024
See application file for complete search history.

(56) References Cited

U.S. PATENT DOCUMENTS 3,347,445 A * 10/1967 Wood ..... B65D 5/5007 206/45.3
5,653,333 A * 8/1997 Webster ..... B42F 7/02 206/45.25
6,675,973 B1 * 1/2004 McDonald ..... B65D 5/5028 206/521
7,182,305 B2 * 2/2007 Dempsey ..... A47F 5/112 206/45.24
D626,964 S * 11/2010 Richardson ..... D14/447
8,746,638 B2 * 6/2014 Carney ..... H04M 1/0202 248/176.1
8,919,544 B2 * 12/2014 Lee ..... G06F 1/1626 206/45.24
8,925,722 B2 * 1/2015 Poon ..... B65B 5/00 206/320
8,950,720 B1 * 2/2015 Carr ..... F16M 11/10 248/460
8,997,984 B2 * 4/2015 Kuo ..... B65D 43/0222 206/320
D730,091 S * 5/2015 Chan ..... B65B 5/00 D6/681
9,145,227 B2 * 9/2015 Huang ..... F16M 13/00
9,194,536 B2 * 11/2015 Kim ..... G06F 1/1632
D811,753 S * 3/2018 Conrad ..... D6/310
10,239,652 B2 * 3/2019 Vanderhulst ..... B65D 5/541
10,265,993 B1 * 4/2019 Rusinque ..... B42D 25/21
2003/0024970 A1 * 2/2003 Lonergan ..... A47G 1/143 229/92.8
2010/0213331 A1 * 8/2010 Liou ..... F16M 11/2021 248/176.3
2012/0279877 A1 * 11/2012 Janis ..... B65D 81/36 206/45.2
2013/0043298 A1 * 2/2013 Takahashi ..... B65D 5/5028 229/100
2014/0158578 A1 * 6/2014 Varan ..... B65D 5/02 206/523
2015/0008147 A1 * 1/2015 Huang ..... F16M 11/00 206/45.24
2016/0341966 A1 * 11/2016 Palanisamy ..... B65D 5/5045
2017/0088342 A1 * 3/2017 Mariano ..... B65D 43/02
2018/0244427 A1 * 8/2018 Lun ..... B65D 75/30

FOREIGN PATENT DOCUMENTS

JP 3174433 U * 3/2012
JP 3174433 U 3/2012
JP 3192893 U9 8/2014
KR 10-1425523 B1 8/2014
KR 101425523 B1 * 8/2014
KR 10-2017-0057686 A 5/2017
KR 20170057686 A * 5/2017
WO WO-2013169694 A2 * 11/2013 ..... H04R 1/026

* cited by examiner

ELECTRONIC DEVICE PACKAGING BOX

CROSS-REFERENCE TO RELATED APPLICATION(S)

This application is a National Phase Entry of PCT International Application No. PCT/KR2019/005092, which was filed on Apr. 26, 2019 and claims priority to Korean Patent Application No. 10-2018-0049218, which was filed on Apr. 27, 2018 in the Korean Intellectual Property Office, the contents of which are incorporated herein by reference.

BACKGROUND

1. Field

Various embodiments of the disclosure relate to a box for packaging an electronic device.

2. Description of the Related Art

In general, electronic devices such as portable communication devices, audio devices, PMPs, and the like are manufactured by a manufacturer, and are packaged and processed in a packaging box to prevent damage when shipped and transported.

Such electronic devices are usually packed with various accessories such as manuals, chargers, various cables, and earphones, and packaging boxes with various structures have been developed for effective packaging of these accessories and small electronic devices.

Most of these packaging boxes have the inside divided into multiple spaces, including an upper space that, when opened, exposes the electronic device, e.g., a portable communication device, and a lower space for receiving accessories.

SUMMARY

Packaging boxes for electronic devices are manufactured focusing substantially on transportation and storage of products, so after delivered to consumers and opened, they are discarded or put aside without use.

Therefore, according to various embodiments of the disclosure, there may be provided a packaging box for an electronic device which may be used to amplify the sound from the speaker of the electronic device or as a cradle for the electronic device.

According to various embodiments of the disclosure, a packaging box may be used together with the electronic device even after opened and used, rather than being put aside or discarded. Thus, resource waste may be prevented. Further, there may be provided a packaging box for an electronic device that may contribute to better use or performance of the electronic device.

However, the objects of the embodiments of the disclosure are not limited thereto, and other various objects may also be present.

According to various embodiments of the disclosure, a packaging box of an electronic device comprises a packaging box body, a receiving part included in the packaging box body and receiving the electronic device, and a supporting structure received in or removed from the receiving part, a portion of the supporting structure selectively able to be slantedly folded to or unfolded from another portion of the supporting structure. The supporting structure in a folded state may be received, together with the electronic device, in the receiving part to support the electronic device to be able to amplify a sound from a speaker and, in a state removed from the receiving part or in a state received in the receiving part, the supporting structure may cradle the electronic device.

According to various embodiments of the disclosure, a packaging box of an electronic device comprises a packaging box body, a receiving part included in the packaging box body and receiving the electronic device, and a supporting structure received in or removed from the receiving part and foldable or unfoldable. When the supporting structure in a folded state is received, together with the electronic device, in the receiving part, the supporting structure may amplify a sound from a speaker included in the electronic device and, in a state removed from the receiving part or in a state received in the receiving part, the supporting structure may cradle the electronic device.

By at least any one of the above-described means to solve the problems, a supporting structure which may be folded or unfolded when received in or removed from the packaging box body may be configured. When an electronic device, together with the supporting structure, is received in the packaging box for the electronic device, the sound from the speaker of the electronic device may be amplified. Thus, it may be used as a power-free sound amplifying speaker, rather than a sound amplifying speaker requiring a separate power source, and the user may enjoy high-quality speaker sound. Further, when the supporting structure is removed from the packaging box, the packaging box may be used as a cradle for the electronic device. Thus, not only does the packaging box package the electronic device, but the packaging box may be used to amplify the sound from the speaker of the electronic device using the supporting structure included in the packaging box and to cradle the electronic device. Therefore, the packaging box may be used together with the electronic device even after opened and used, rather than being put aside or discarded. Thus, resource waste may be prevented, and the packaging box may contribute to better use or performance of the electronic device.

BRIEF DESCRIPTION OF THE DRAWINGS

The same or similar reference denotations may be used to refer to the same or similar elements throughout the specification and the drawings.

DETAILED DESCRIPTION

The electronic device according to various embodiments may be one of various types of electronic devices. The electronic devices may include at least one of, e.g., a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the techniques set forth herein to particular embodiments and that various changes, equivalents, and/or replacements therefor also fall within the scope of the disclosure. The same or similar reference denotations may be used to refer to the same or similar elements throughout the specification and the drawings. It is to be understood that the singular forms "a," "an," and "the" include plural references unless the context clearly dictates otherwise. As used herein, the term "A or B," "at least one of A and/or B," "A, B, or C," or "at least one of A, B, and/or C" may include all possible combinations of the enumerated items. As used herein, the terms "first" and "second" may modify various components regardless of importance and/or order and are used to distinguish a component from another without limiting the components. It will be understood that when an element (e.g., a first element) is referred to as being (operatively or communicatively) "coupled with/to," or "connected with/to" another element (e.g., a second element), it can be coupled or connected with/to the other element directly or via a third element.

As used herein, the term "module" includes a unit configured in hardware, software, or firmware and may interchangeably be used with other terms, e.g., "logic," "logic block," "part," or "circuit." A module may be a single integral part or a minimum unit or part for performing one or more functions. For example, the module may be configured in an application-specific integrated circuit (ASIC).

Figure 1A:
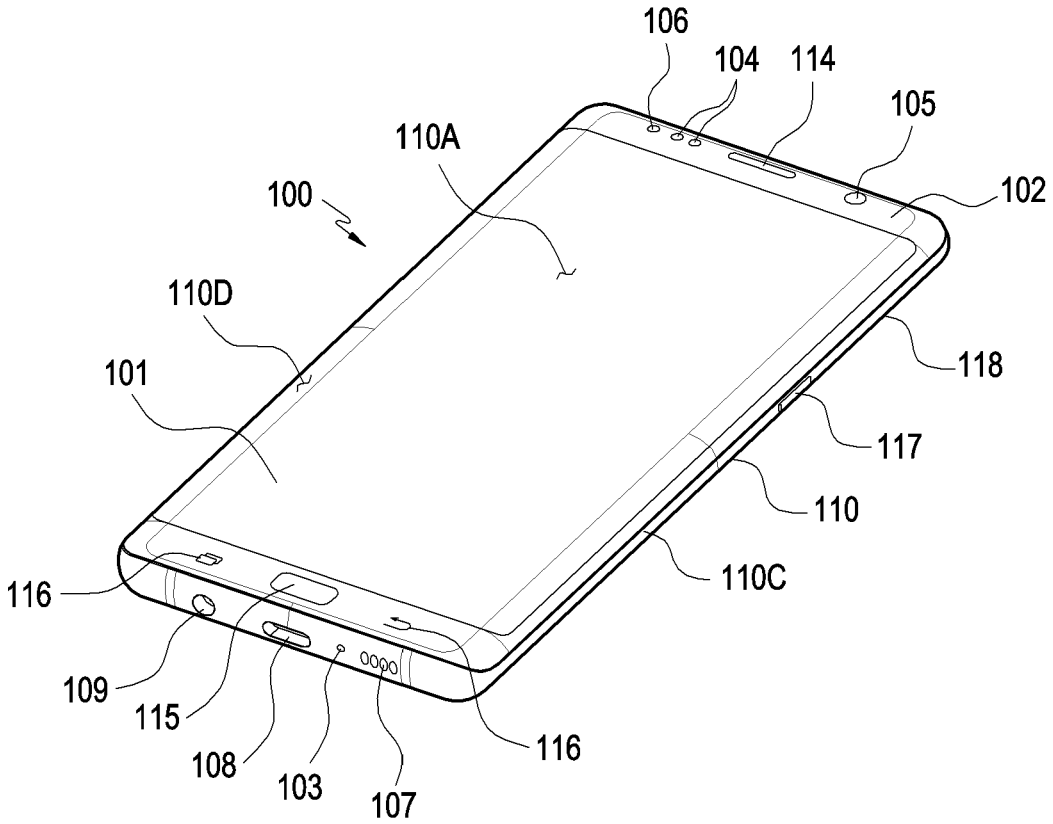
FIG. 1A is a perspective view illustrating a front surface of an electronic device according to various embodiments of the disclosure.

Various embodiments as set forth herein may be implemented as software (e.g., a program) containing commands that are stored in a machine (e.g., computer)-readable storage medium (e.g., an internal memory) or an external memory. The machine may be a device that may invoke a command stored in the storage medium and may be operated as per the invoked command. The machine may include an electronic device (e.g., the electronic device 100 of FIG. 1A) according to embodiments disclosed herein. When the command is executed by a processor, the processor may perform a function corresponding to the command on its own or using other components under the control of the processor. The command may contain a code that is generated or executed by a compiler or an interpreter. The machine-readable storage medium may be provided in the form of a non-transitory storage medium. Here, the term "non-transitory" simply means that the storage medium does not include a signal and is tangible, but this term does not differentiate between where data is semipermanently stored in the storage medium and where data is temporarily stored in the storage medium.

A method according to various embodiments of the disclosure may be included and provided in a computer program product. The computer program products may be traded as commodities between sellers and buyers. The computer program product may be distributed in the form of a machine-readable storage medium (e.g., a compact disc read only memory (CD-ROM)) or online through an application store (e.g., Playstore™). When distributed online, at least part of the computer program product may be temporarily generated or at least temporarily stored in a storage medium, such as the manufacturer's server, a server of the application store, or a relay server.

According to various embodiments, each component (e.g., a module or program) may be configured of a single or multiple entities, and the various embodiments may exclude some of the above-described sub components or add other sub components. Alternatively or additionally, some components (e.g., modules or programs) may be integrated into a single entity that may then perform the respective (pre-integration) functions of the components in the same or similar manner. According to various embodiments, operations performed by modules, programs, or other components may be carried out sequentially, in parallel, repeatedly, or heuristically, or at least some operations may be executed in a different order or omitted, or other operations may be added.

Figure 1B:
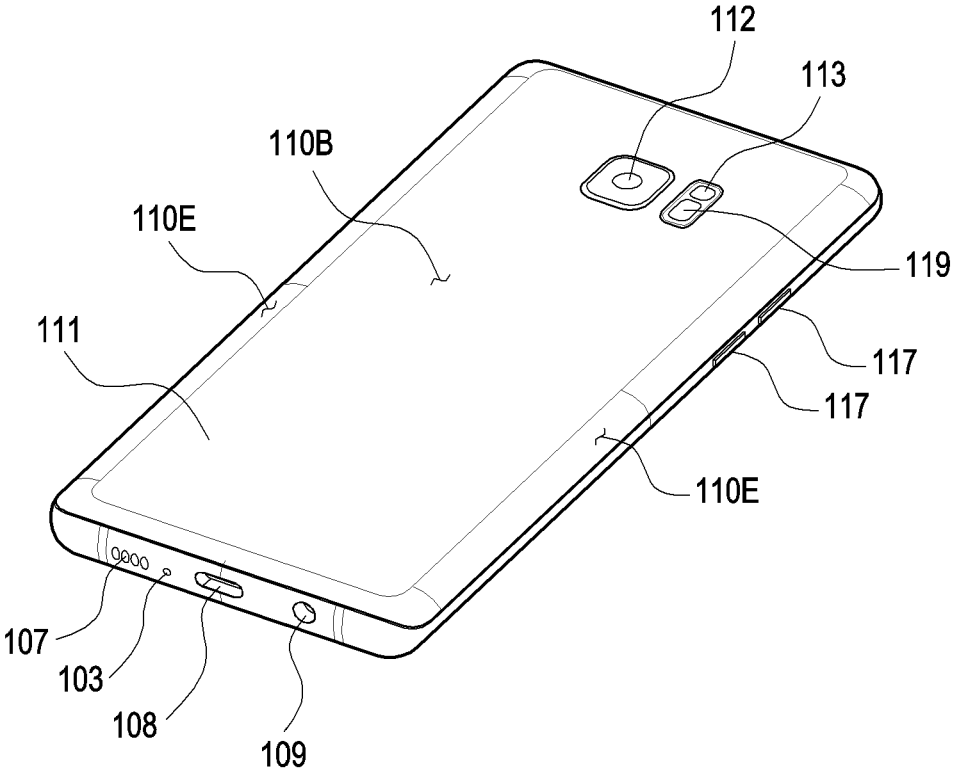
FIG. 1B is a perspective view illustrating a rear surface of an electronic device according to various embodiments of the disclosure.
Figure 1C:
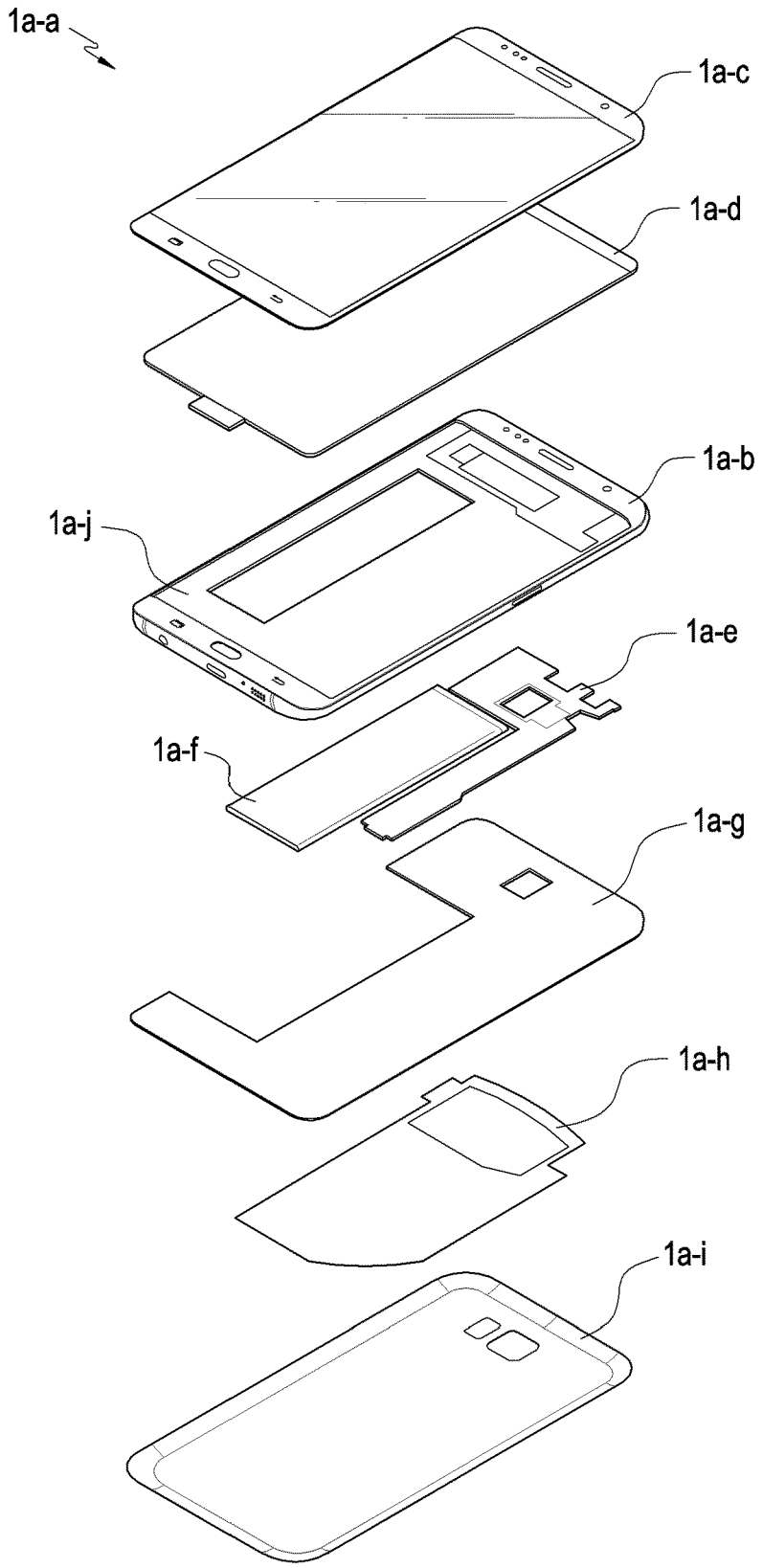
FIG. 1C is an exploded perspective view illustrating an electronic device according to various embodiments of the disclosure.
Figure 2:
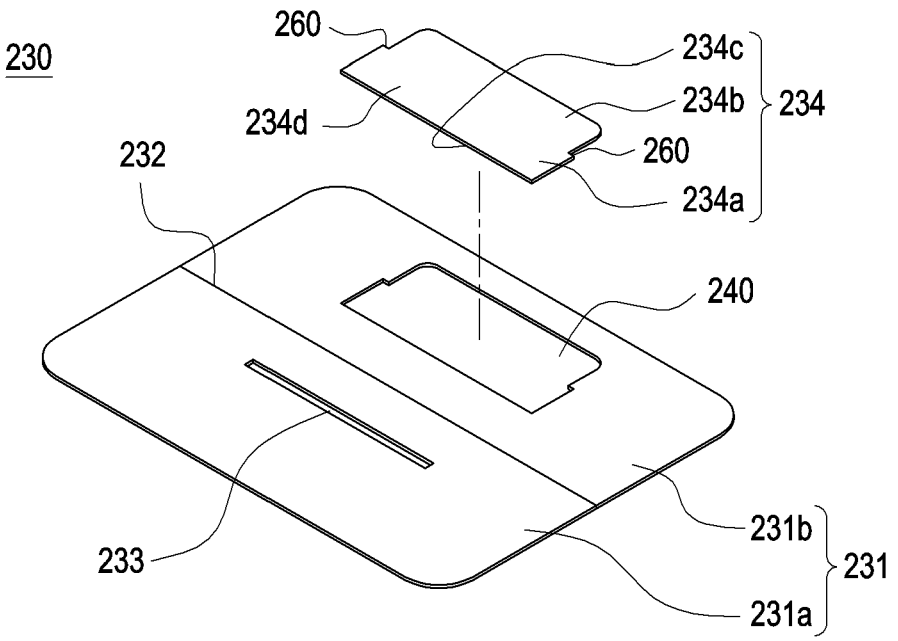
FIG. 2 is an exploded perspective view illustrating a configuration of a supporting structure included in a packaging box of an electronic device, with a speaker positioned on a side surface/back surface, according to various embodiments of the disclosure.

Referring to FIGS. 1 and 2, according to an embodiment, an electronic device 100 may include a housing 110 with a first (or front) surface 110A, a second (or back) surface 110B, and a side surface 110C surrounding a space between the first surface 110A and the second surface 110B. According to another embodiment (not shown), the housing may denote a structure forming part of the first surface 110A, the second surface 110B, and the side surface 110C of FIG. 1. According to an embodiment, at least part of the first surface 110A may have a substantially transparent front plate 102

(e.g., a glass plate or polymer plate including various coat layers). The second surface 110B may be formed of a substantially opaque back plate 111. The back plate 111 may be formed of, e.g., laminated or colored glass, ceramic, polymer, metal (e.g., aluminum, stainless steel (STS), or magnesium), or a combination of at least two thereof. The side surface 110C may be formed by a side bezel structure (or a "side member") 118 that couples to the front plate 102 and the back plate 111 and includes a metal and/or polymer. According to an embodiment, the back plate 111 and the side bezel plate 118 may be integrally formed together and include the same material (e.g., a metal, such as aluminum).

In the embodiment illustrated, the front plate 102 may include two first regions 110D, which seamlessly and bendingly extend from the first surface 110A to the back plate 111, on both the long edges of the front plate 102. In the embodiment (refer to FIG. 2) illustrated, the back plate 111 may include second regions 110E, which seamlessly and bendingly extend from the second surface 110B to the front plate 102, on both the long edges. According to an embodiment, the front plate 102 (or the back plate 111) may include only one of the first regions 110D (or the second regions 110E). Alternatively, the first regions 110D or the second regions 110E may partially be excluded. According to an embodiment, at side view of the electronic device 100, the side bezel structure 118 may have a first thickness (or width) for sides that do not have the first regions 110D or the second regions 110E and a second thickness, which is smaller than the first thickness, for sides that have the first regions 110D or the second regions 110E.

According to an embodiment, the electronic device 100 may include at least one or more of a display 101, audio modules 103, 107, and 114, sensor modules 104 and 119, camera modules 105, 112, and 113, key input devices 115, 116, and 117, an indicator 106, and connector holes 108 and 109. According to an embodiment, the electronic device 100 may exclude at least one (e.g., the key input devices 115, 116, and 117 or the indicator 106) of the components or may add other components.

The display 101 may be exposed through the top of, e.g., the front plate 102. According to an embodiment, at least a portion of the display 101 may be exposed through the front plate 102 forming the first surface 110A and the first regions 110D of the side surface 110C. The display 101 may be disposed to be coupled with, or adjacent, a touch detecting circuit, a pressure sensor capable of measuring the strength (pressure) of touches, and/or a digitizer for detecting a magnetic field-type stylus pen. According to an embodiment, at least part of the sensor modules 104 and 119 and/or at least part of the key input devices 115, 116, and 117 may be disposed in the first regions 110D and/or the second regions 110E.

The audio modules 103, 107, and 114 may include a microphone hole 103 and speaker holes 107 and 114. The microphone hole 103 may have a microphone inside to obtain external sounds. According to an embodiment, there may be a plurality of microphones to be able to detect the direction of a sound. The speaker holes 107 and 114 may include an external speaker hole 107 and a phone receiver hole 114. According to an embodiment, the speaker holes 107 and 114 and the microphone hole 103 may be implemented as a single hole, or speakers may be rested without the speaker holes 107 and 114 (e.g., piezo speakers).

The sensor modules 104 and 119 may generate an electrical signal or data value corresponding to an internal operating state or external environmental state of the electronic device 100. The sensor modules 104, and 119 may include a first sensor module 104 (e.g., a proximity sensor) and/or a second sensor module (not shown) (e.g., a fingerprint sensor) disposed on the first surface 110A of the housing 110 and/or a third sensor module 119 (e.g., an HRM sensor) disposed on the second surface 110B of the housing 110. The fingerprint sensor may be disposed on the second surface 110B as well as on the first surface 110A (e.g., the home key button 115) of the housing 110. The electronic device 100 may further include sensor modules not shown, e.g., at least one of a gesture sensor, a gyro sensor, an atmospheric pressure sensor, a magnetic sensor, an acceleration sensor, a grip sensor, a color sensor, an infrared (IR) sensor, a biometric sensor, a temperature sensor, a humidity sensor, or an illuminance sensor 104.

The camera modules 105, 112, and 113 may include a first camera device 105 disposed on the first surface 110A of the electronic device 100, and a second camera device 112 and/or a flash 113 disposed on the second surface 110B. The camera modules 105 and 112 may include one or more lenses, an image sensor, and/or an image signal processor. The flash 113 may include, e.g., a light emitting diode (LED) or a xenon lamp. According to an embodiment, two or more lenses (an infrared (IR) camera, a wide-angle lens, and a telescopic lens) and image sensors may be disposed on one surface of the electronic device 100.

The key input devices 115, 116, and 117 may include a home key button 115 disposed in the first surface 110A of the housing 110, a touchpad 116 disposed around the home key button 115, and/or a side key button 117 disposed on the side surface 110C of the housing 110. According to an embodiment, the electronic device 100 may exclude all or some of the above-mentioned key input devices 115, 116, and 117 and the excluded key input devices 115, 116, and 117 may be implemented in other forms, e.g., as soft keys on the display 101.

The indicator 106 may be disposed on, e.g., the first surface 110A of the housing 110. The indicator 106 may provide, e.g., state information about the electronic device 100 in the form of light and may include an LED.

The connector holes 108 and 109 may include a first connector hole 108 for receiving a connector (e.g., a universal serial bus (USB) connector) for transmitting or receiving power and/or data to/from an external electronic device and/or a second connector hole 109 (e.g., an earphone jack) for receiving a connector for transmitting or receiving audio signals to/from the external electronic device.

Referring to FIG. 1C, an electronic device l*a-a* may include a side bezel structure 1*a-b*, a first supporting member 1*a-j* (e.g., a bracket), a front plate 1*a-c*, a display 1*a-d*, a printed circuit board 1*a-e*, a battery 1*a-f*, a second supporting member 1*a-g* (e.g., a rear case), an antenna 1*a-h*, and a back plate 1*a-i*. According to some embodiments, the electronic device 1*a-a* may exclude at least one (e.g., the first supporting member 1*a-j* or the second supporting member 1*a-g*) of the components or may add other components. At least one of the components of the electronic device 1*a-a* may be the same or similar to at least one of the components of the electronic device 100 of FIG. 1A or 1B and no duplicate description is made below.

The first supporting member 1*a-j* may be disposed inside the electronic device 1*a-a* to be connected with the side bezel structure 1*a-b* or integrated with the side bezel structure 1*a-b*. The first supporting member 1*a-j* may be formed of, e.g., a metal and/or non-metallic material (e.g., polymer). The display 1*a-d* may be joined onto one surface of the first supporting member 1*a-j*, and the printed circuit board 1*a-e* may be joined onto the opposite surface of the first supporting member 1*a-j*. A processor, memory, and/or interface may be cradled on the printed circuit board 1*a-e*. The processor may include one or more of, e.g., a central processing unit, an application processor, a graphic processing device, an image signal processing, a sensor hub processor, or a communication processor.

The memory may include, e.g., a volatile or non-volatile memory.

The interface may include, e.g., a high definition multimedia interface (HDMI), a universal serial bus (USB) interface, a secure digital (SD) card interface, and/or an audio interface. The interface may electrically or physically connect, e.g., the electronic device 1*a-a* with an external electronic device and may include a USB connector, an SD card/multimedia card (MMC) connector, or an audio connector.

The battery 1*a-f* may be a device for supplying power to at least one component of the electronic device 1*a-a*. The battery 1*a-f* may include, e.g., a primary cell which is not rechargeable, a secondary cell which is rechargeable, or a fuel cell. At least a portion of the battery 1*a-f* may be disposed on substantially the same plane as the printed circuit board 1*a-e*. The battery 1*a-f* may be integrally or detachably disposed inside the electronic device 1*a-a*.

The antenna 1*a-h* may be disposed between the back plate 1*a-i* and the battery 1*a-f*. The antenna 1*a-h* may include, e.g., a near-field communication (NFC) antenna, a wireless charging antenna, and/or a magnetic secure transmission (MST) antenna. The antenna 1*a-h* may perform short-range communication with, e.g., an external device or may wirelessly transmit or receive power necessary for charging. According to another embodiment, an antenna structure may be formed by a portion or combination of the side bezel structure 1*a-b* and/or the first supporting member 1*a-j*. The following description is made taking the electronic device 100 of FIGS. 1A to 1C as an example, but embodiments of the disclosure are not limited thereto. For example, it should be noted that the kind or shape of the electronic device is not limited to the above-described embodiments.

Figure 3:
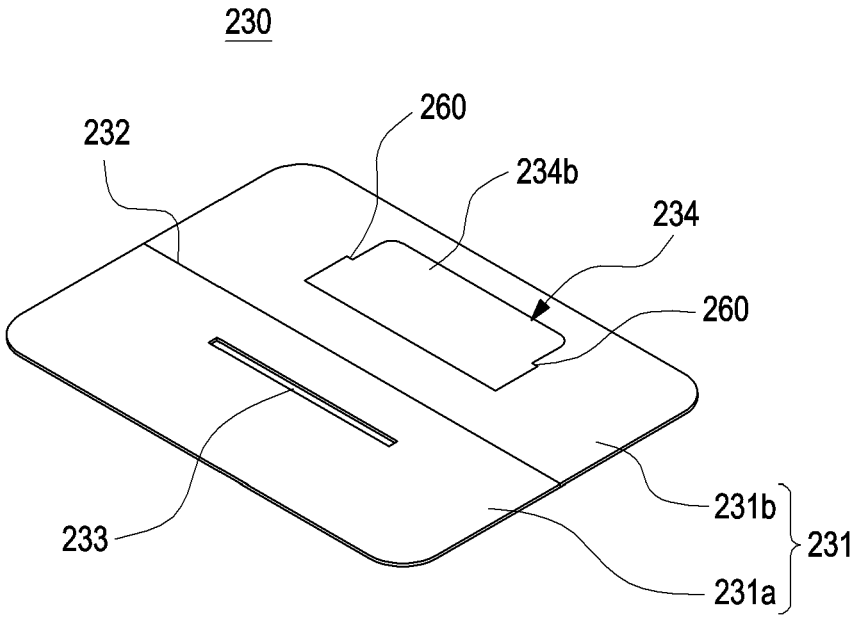
FIG. 3 is a perspective view illustrating a combined state of a supporting structure included in a packaging box of an electronic device, with a speaker positioned on a side surface/back surface, according to various embodiments of the disclosure.

FIG. 2 is an exploded perspective view illustrating a configuration of a supporting structure 230 included in a packaging box (e.g., 200 of FIG. 7) of an electronic device (e.g., 100 of FIG. 7), with a speaker (e.g., 100*a* of FIG. 7) positioned on a side surface/back surface, according to various embodiments of the disclosure. FIG. 3 is a perspective view illustrating a combined state of a supporting structure 230 included in a packaging box (e.g., 200 of FIG. 7) of an electronic device, with a speaker (e.g., 100*a* of FIG. 7) positioned on a side surface/back surface, according to various embodiments of the disclosure.

Figure 7:
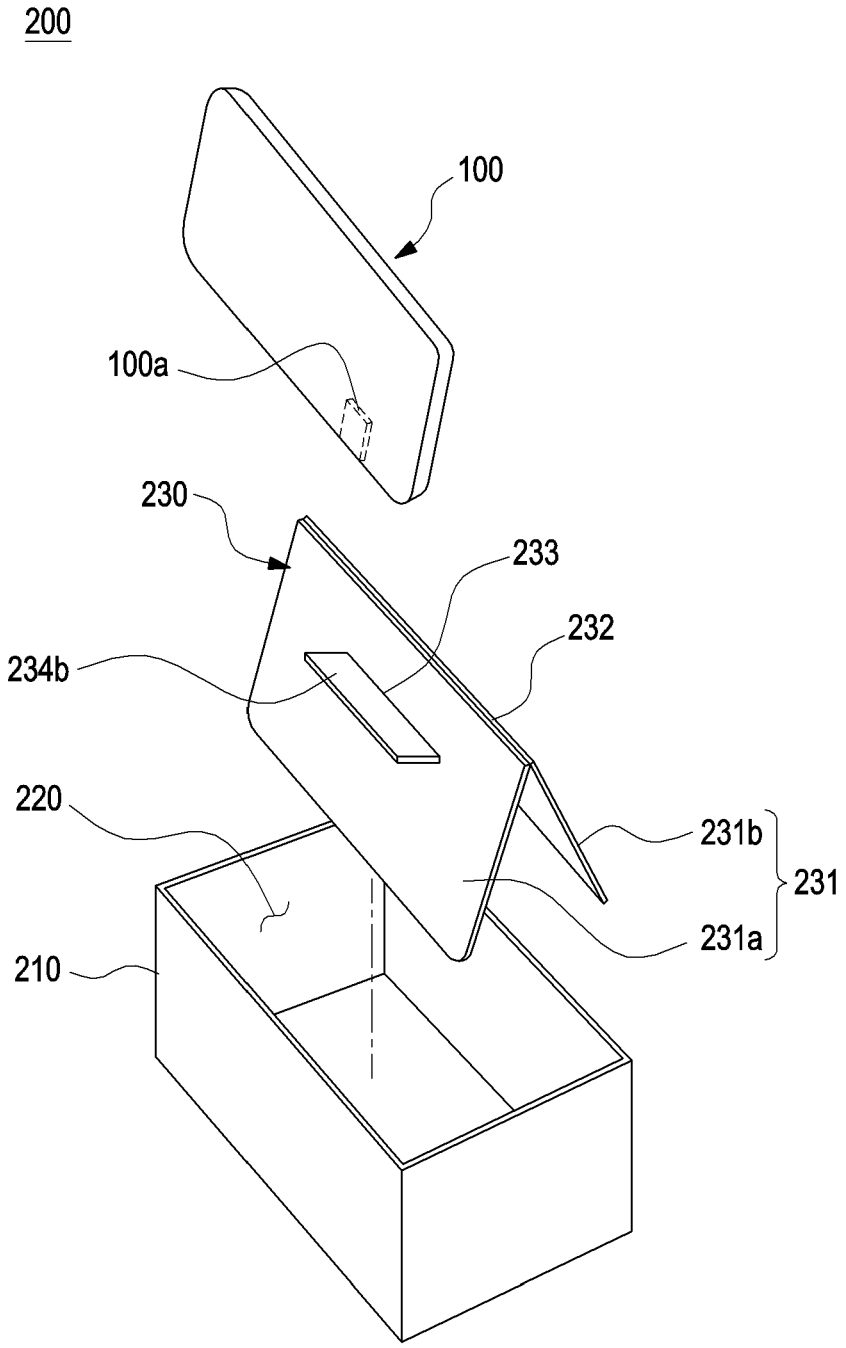
FIG. 7 is an exploded perspective view illustrating an example in which a supporting structure is received in a packaging box when used for sound amplification, according to various embodiments of the disclosure.

Referring to FIGS. 2 and 3, according to various embodiments, a speaker (e.g., 100*a* of FIG. 7) may be positioned on a side surface/back surface of the electronic device (e.g., 100 of FIG. 7). The packaging box (e.g., 200 of FIG. 7) of the electronic device (e.g., 100 of FIG. 7) may include a packaging box body (e.g., 210 of FIG. 7), a receiving part (e.g., 220 of FIG. 7), and/or a supporting structure 230. For example, the supporting structure 230 or various accessories of the electronic device may be packaged in the packaging box body 210. The receiving part 220 may provide a space for receiving the electronic device (e.g., 100 of FIG. 7) or the supporting structure 230. The supporting structure 230 may be included in the receiving part 220 and be folded to amplify the sound from the speaker (e.g., 100*a* of FIG. 7) positioned on the side surface/back surface of the electronic device (e.g., 100 of FIG. 7) or to cradle the electronic device (e.g., 100 of FIG. 7). The supporting structure 230 may be received together with the packaging box body 210, enhancing the usability (e.g., convenience) of the electronic device or supplementing the performance of the electronic device, e.g., amplifying the sound from the speaker (e.g., 100*a* of FIG. 7) included in the electronic device (e.g., 100 of FIG. 7).

The speaker (e.g., 100*a* of FIG. 7) may be positioned on a side surface/back surface of the electronic device (e.g., 100 of FIG. 7) or on the bottom of the electronic device (e.g., 100 of FIG. 7). In the instant embodiment described, the speaker (e.g., 100*a* of FIG. 7) is positioned on a side surface/back surface of the electronic device (e.g., 100 of FIG. 7).

As such, the supporting structure 230 in a folded state may be received, together with the electronic device (e.g., 100 of FIG. 7), in the receiving part 220 of the packaging box body 210 to provide support to be able to amplify the sound from the speaker (e.g., 100*a* of FIG. 7). Further, when the folded supporting structure 230 is used as a cradle, the supporting structure 230 may cradle the electronic device (e.g., 100 of FIG. 7) after removed from the receiving part 220 of the packaging box body 210 or while received in the receiving part 220 of the packaging box body 210.

The material of the supporting structure 230 may include at least one of paper, plastic, or wood. In the instant embodiment described, the material of the supporting structure 230 is paper, plastic, or wood, but is not limited thereto. For example, other various materials may be adopted for the supporting structure 230, as long as they may be folded and unfolded.

The supporting structure 230 may include at least one of a manual box, a container for receiving the accessories of the electronic device, or a partition.

Figure 4:
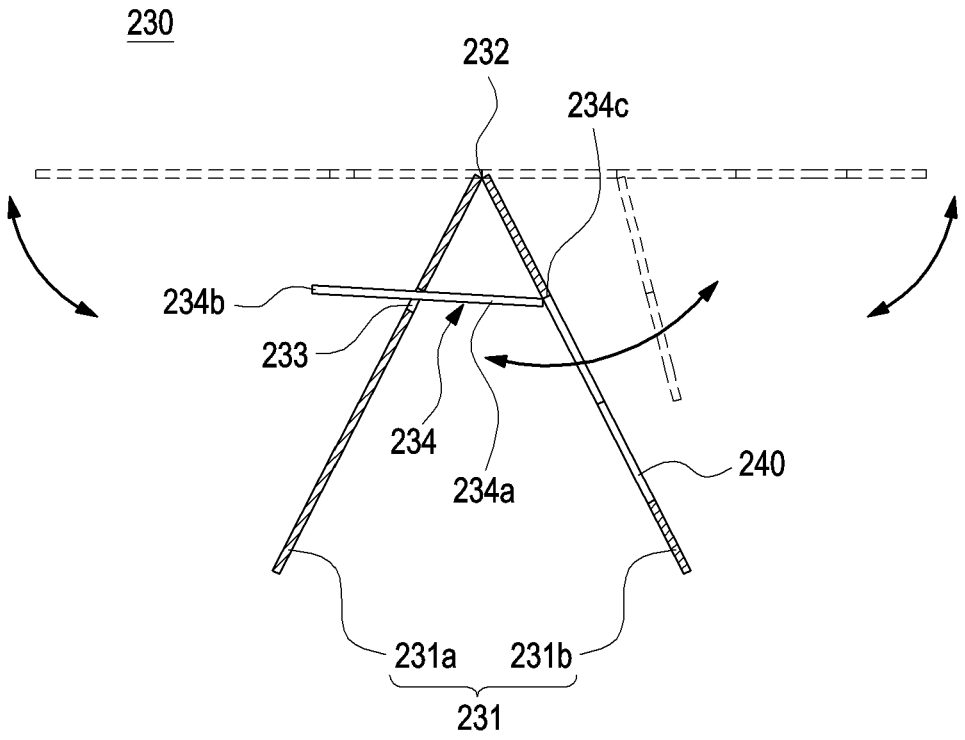
FIG. 4 is a side view illustrating a process of folding a supporting structure included in a packaging box of an electronic device, with a speaker positioned on a side surface/back surface, according to various embodiments of the disclosure.
Figure 5:
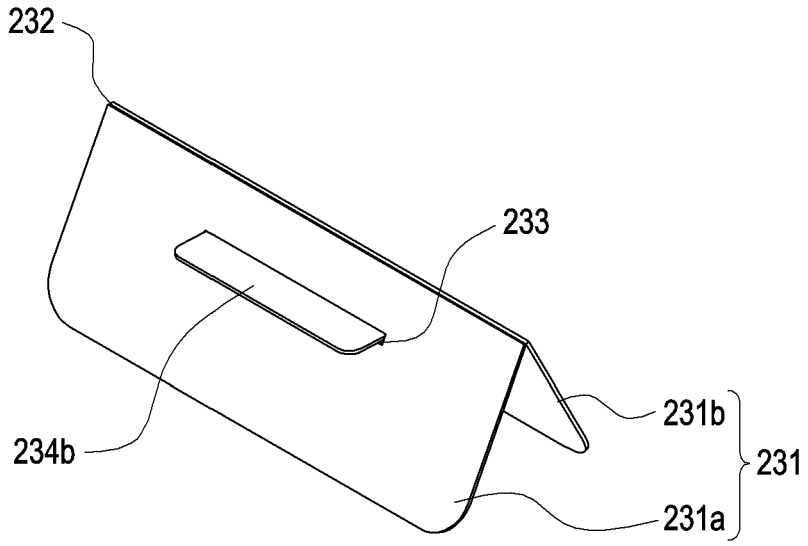
FIG. 5 is a perspective view illustrating a folded state of a supporting structure included in a packaging box of an electronic device, with a speaker positioned on a side surface/back surface, according to various embodiments of the disclosure.

FIG. 4 is a side view illustrating a process of folding a supporting structure 230 included in a packaging box 200 of an electronic device (e.g., 100 of FIG. 7), with a speaker (e.g., 100*a* of FIG. 7) positioned on a side surface/back surface, according to various embodiments of the disclosure. FIG. 5 is a perspective view illustrating a folded state of a supporting structure 230 included in a packaging box 200 of an electronic device, with a speaker (e.g., 100*a* of FIG. 7) positioned on a side surface/back surface, according to various embodiments of the disclosure.

Referring to FIGS. 4 and 5, the supporting structure 230 may include a supporting structure body 231, a folding part 232, a coupling hole 233, and a coupling part 234. For example, the supporting structure body 231 may be divided into a first portion 231*a* and a second portion 231*b* by the folding part 232 described below. For example, the folding part 232 may be formed between the first portion 231*a* and the second portion 231*b*. As bent at the folding part 232, the first portion 231*a* and the second portion 231*b* may be rotated, folded, or unfolded with respect to each other. The coupling hole 233 may be formed in at least a portion of the first portion 231*a* to be coupled with the coupling part 234 described below. The coupling part 234 may be received in or coupled to a cut portion 240 formed in at least a portion of the second portion 231*b* and be rotated around a rotation part described below. According to an embodiment, the coupling part 234, in a state of escaping from the cut portion 240, may be coupled to or removed from the coupling hole 233.

For example, the coupling part 234 may be coupled to or removed from the coupling hole 233 to allow the supporting structure 230 to be used to amplify the sound from the speaker (e.g., 100*a* of FIG. 7) positioned on the side surface/back surface of the electronic device (e.g., 100 of FIG. 7) or to be used as a cradle.

For example, in the state of the coupling part 234 being coupled to the coupling hole 233, the first portion 231*a* and the second portion 231*b* may remain slated with respect to each other. In the state of the first and second portions 231*a* and 231*b* remaining slanted with respect to each other, the supporting structure 230 may be used as a structure to cradle or support the electronic device (e.g., 100 of FIG. 7) with the speaker (e.g., 100*a* of FIG. 7) positioned on the side surface/back surface. For example, if the electronic device (e.g., 100 of FIG. 7) in the state of being supported by the supporting structure 230 is received in the receiving part (e.g., 220 of FIG. 7) of the packaging box body (e.g., 210 of FIG. 7), the packaging box body (e.g., 210 of FIG. 7) and the supporting structure 230 may be used to amplify the sound from the speaker (e.g., 100*a* of FIG. 7) positioned on the side surface/back surface of the electronic device (e.g., 100 of FIG. 7), and the supporting structure 230, in the state removed from or received in the packaging box body (e.g., 210 of FIG. 7) may be used as a cradle for the electronic device (e.g., 100 of FIG. 7).

As described above in connection with FIGS. 2 and 3, the coupling part 234 may include a coupling body 234*a*, a coupling member 234*b*, a rotation part 234*c*, and/or a support 234*d*. For example, the coupling body 234*a* may include the coupling member 234*b* and the rotation part 234*c* described below. The coupling member 234*b* may be formed in an end of the coupling body 234*a* to be coupled to or removed from the coupling hole 233 as rotated, as described below. The rotation part 234*c* may be formed in at least a portion of the second portion 231*b* and may be formed in the other end of the coupling member 234*b* to rotate the coupling member 234*b*. In an embodiment, the coupling member 234*b* may rotate around the rotation part 234*c* from the second portion 231*b* and be thus received in the cut portion 240. The support 234*d* may be included in at least a portion of the coupling body 234*a* and be formed between the coupling member 234*b* and the rotation part 234*c* to support the coupling member 234*b*.

According to an embodiment, when the coupling part 234 is coupled to the coupling hole 233, the coupling member 234*b* may be rotated around the rotation part 234*c*, and the rotated coupling member 234*b* may be coupled to the coupling hole 233. At this time, the support 234*d* may support the state of being coupled to the coupling hole 233 while simultaneously supporting the rotation of the coupling member 234*b*.

Figure 6A:
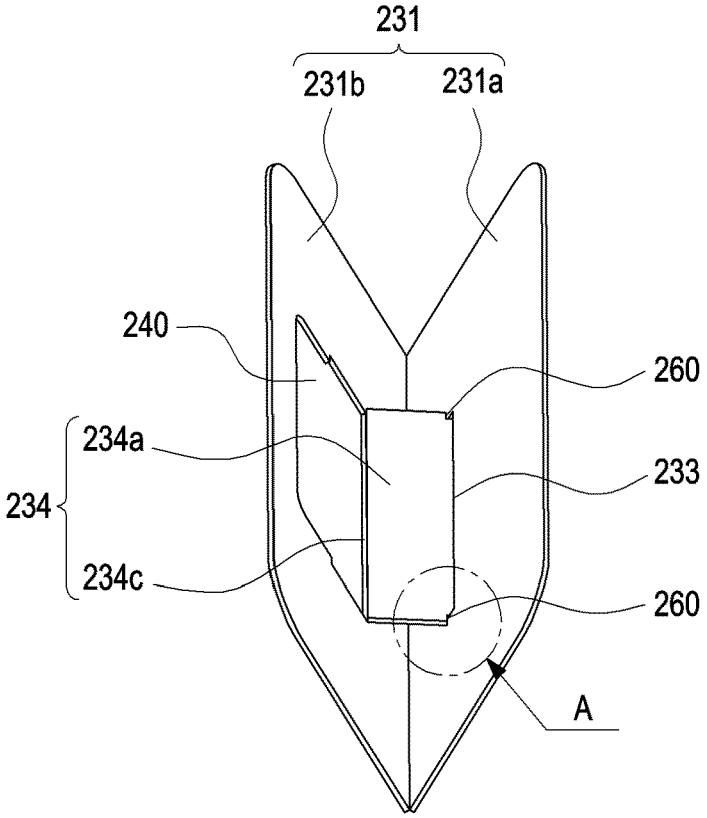
FIG. 6A is an internal perspective view illustrating a folded state of a supporting structure included in a packaging box of an electronic device, with a speaker positioned on a side surface/back surface, according to various embodiments of the disclosure.
Figure 6B:
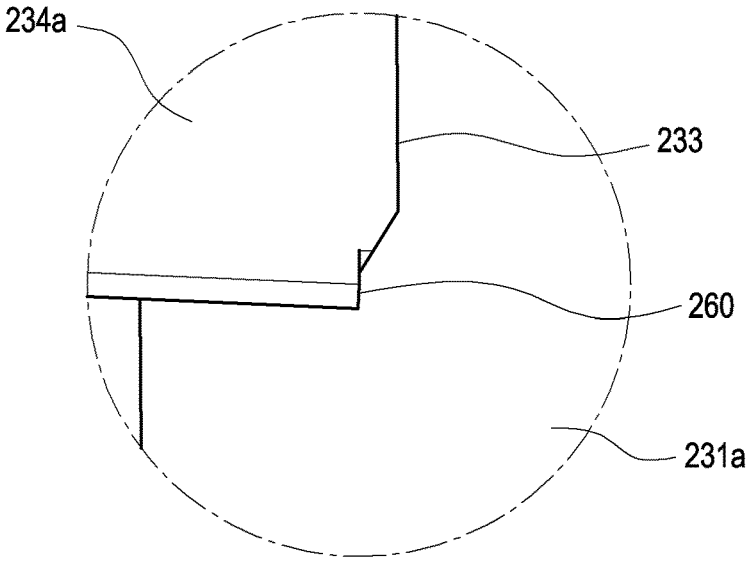
FIG. 6B is an enlarged internal perspective view of portion A of FIG. 6A.

FIG. 6A is an internal perspective view illustrating a folded state of a supporting structure 230 included in a packaging box 200 of an electronic device, with a speaker (e.g., 100*a* of FIG. 7) positioned on a side surface/back surface, according to various embodiments of the disclosure. FIG. 6B is an enlarged internal perspective view of portion A of FIG. 6A.

Referring to FIGS. 6A and 6B, at least one latching jaw 260 may be formed in the coupling member 234*b* to be stuck to the coupling hole 233 to allow it to project a predetermined length from the coupling hole 233 when inserted to the coupling hole 233. For example, the coupling part 234 formed in the second portion 231*b* may be rotated and removed from the cut portion 240. At this time, the coupling part 234 may be rotated by the rotation part 234*c*. At this time, the coupling member 234*b* formed in one end of the coupling part 234 may be fitted into the coupling hole 233 while projecting a predetermined length from the coupling hole 233. At this time, the latching jaw 260 of the coupling member 234*b* is stuck to the coupling hole 233. In other words, the coupling member 234*b* is stuck to the coupling hole 233 by the latching jaw 260 while being prevented from projecting beyond the predetermined length or more from the coupling hole 233.

As such, in the supporting structure 230, the first portion 231*a* and the second portion 231*b* may be folded by the folding part 232 formed between the first portion 231*a* and the second portion 231*b* as shown in FIG. 4. The coupling part 234 formed in at least a portion of the second portion 231*b* may be rotated by the rotation part 234*c* to be removed from the cut portion 240 formed in at least a portion of the second portion 231*b*, and the coupling member 234*b* of the removed coupling part 234 may be coupled to the coupling hole 233 while simultaneously projecting a predetermined length from the coupling hole 233. At this time, the latching jaw 260 of the coupling member 234*b* may be stuck and fastened to the coupling hole 233, and the latching jaw 260 may be stuck to the coupling hole 233 to prevent the coupling member 234*b* from projecting beyond the predetermined length from the coupling hole 233.

In the folded state of the supporting structure 230, the first portion 231*a* and the second portion 231*b* may be slanted from each other while forming a triangle. The folded supporting structure 230, along with the electronic device (e.g., 100 of FIG. 7), may be received in the receiving part 220 of the packaging box body 210. At this time, the bottom (e.g., the respective ends of the first portion and the second portion positioned substantially parallel with each other and spaced apart from each other) of the supporting structure 230 in the triangular shape may be disposed on the bottom surface of the receiving part 220, and the top of the triangular supporting structure 230 may be positioned over the receiving part 220.

Figure 8:
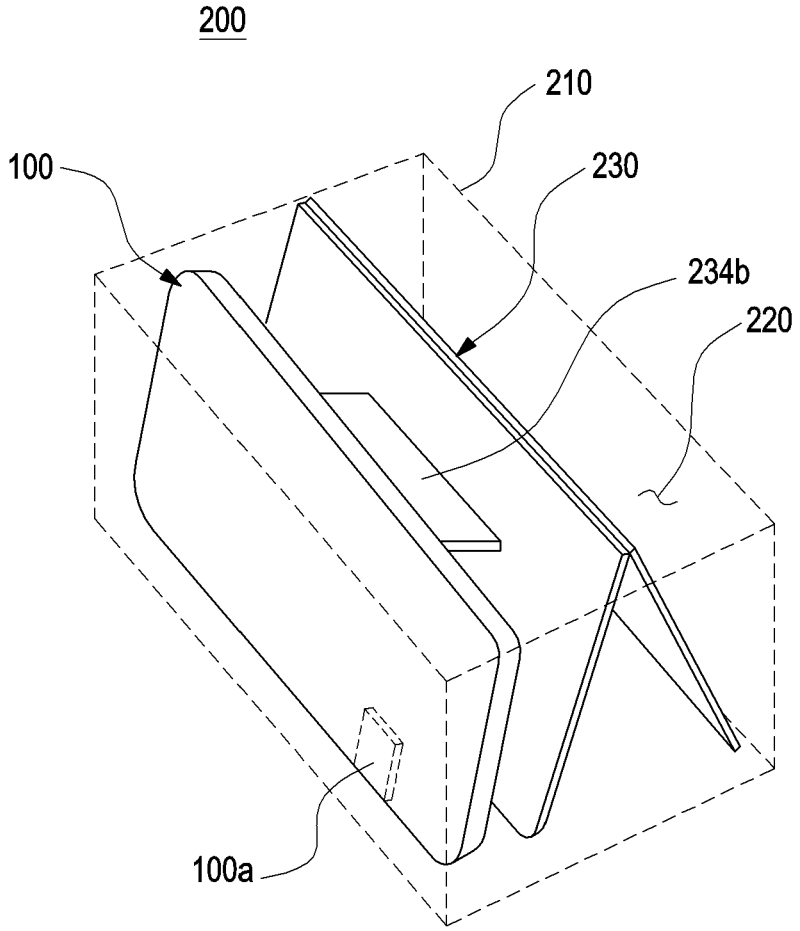
FIG. 8 is a perspective view illustrating a state of being received in a packaging box when a supporting structure is used for sound amplification, according to various embodiments of the disclosure.

FIG. 7 is a perspective view illustrating an example in which a supporting structure 230 is received in a packaging box 200 when used for sound amplification, according to various embodiments of the disclosure. FIG. 8 is a perspective view illustrating a state of being received in a packaging box 200 when a supporting structure 230 is used for sound amplification, according to various embodiments of the disclosure.

Referring to FIGS. 7 and 8, the folded supporting structure 230 may be received, along with the electronic device 100, in the receiving part 220 of the packaging box body 210 to amplify the sound from the speaker (e.g., 100*a* of FIG. 7) positioned on the side surface/back surface of the electronic device 100. The supporting structure 230 may be received in the length direction of the packaging box body 210 and support the electronic device 100 in a position tilted backward. As shown in FIG. 8, the supporting structure 230 received in the receiving part 220 of the packaging box body 210 may support the electronic device 100 in the slanted state.

According to an embodiment, it may be utilized as a structure (e.g., a power-free sound amplifying speaker) that, if the speaker 100*a* outputs sound, with the speaker 100*a* positioned on the side surface/back surface of the electronic device 100 facing the bottom of the receiving part 220 of the packaging box body 210, reflects and amplifies the output sound in the receiving part 220 of the packaging box body 210. For example, the sound output from the speaker 100*a* may be reflected by the inner wall of the packaging box body 210, and the reflected sound may be reflected by the supporting structure 230 or travel along a space formed by the supporting structure 230. Thus, the sound may be amplified while traveling along the shape or space of the supporting structure 230.

As such, the sound output from the speaker 100*a* positioned on the side surface/back surface of the electronic device 100 may be reflected and amplified by the supporting structure 230 or the inner surface of the receiving part 220 of the packaging box body 210. Thus, the output sound may be amplified in its mid-bass band, and rich bass band amplification may be achieved.

Figure 9:
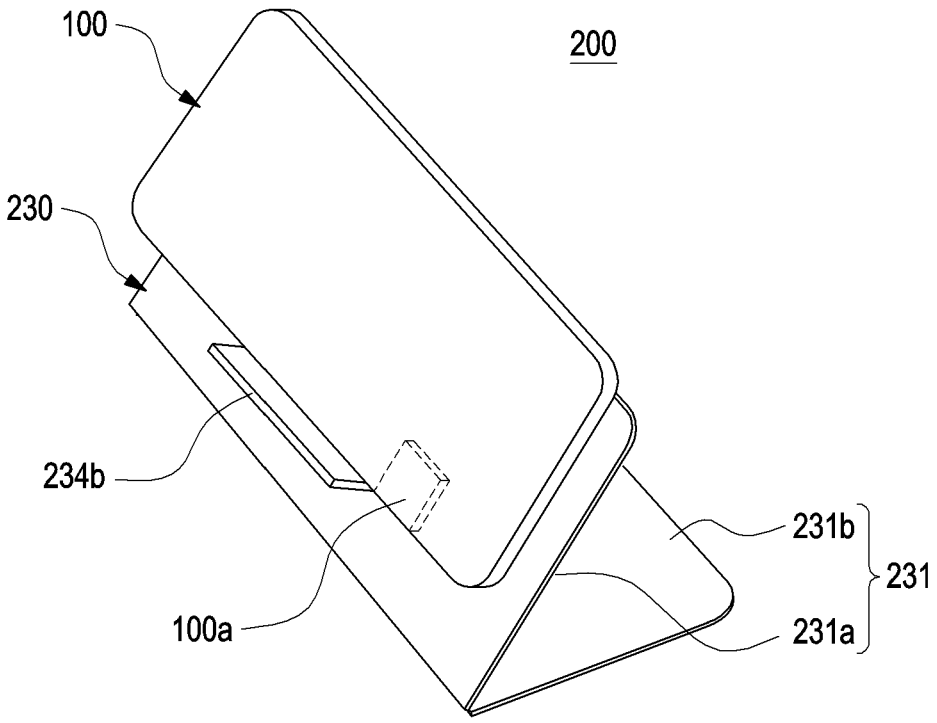
FIG. 9 is a perspective view illustrating a state in which a supporting structure is used as a cradle according to various embodiments of the disclosure.

FIG. 9 is a perspective view illustrating a state in which a supporting structure 230 is used as a cradle according to various embodiments of the disclosure.

Referring to FIG. 9, the supporting structure 230 may be used as a cradle for the electronic device, in the state removed from the receiving part 220 of the packaging box body 210 or received in the receiving part 220 of the packaging box body 210. For example, in the supporting structure 230, the second portion 231*b* may be positioned to face the bottom while the first portion 231*a* is slanted. In this case, since in the slanted first portion 231*a*, the coupling member 234*b* formed in the coupling part 234 of the supporting structure 230 projects a predetermined length from the coupling hole 233, the electronic device 100 may be placed and cradled on the projecting coupling member 234*b*.

As such, since the supporting structure 230 may be used as a cradle for the electronic device 100, the user may listen to music or watch video via the electronic device 100 cradled on the supporting structure 230.

Thus, not only does the packaging box 200 package the electronic device 100, but the packaging box 200 may function to amplify the sound from the speaker 100*a* positioned on the side surface/back surface of the electronic device 100 using the supporting structure 230 received in or removed from the packaging box 200 or be used as a cradle for the electronic device 100.

Figure 10:
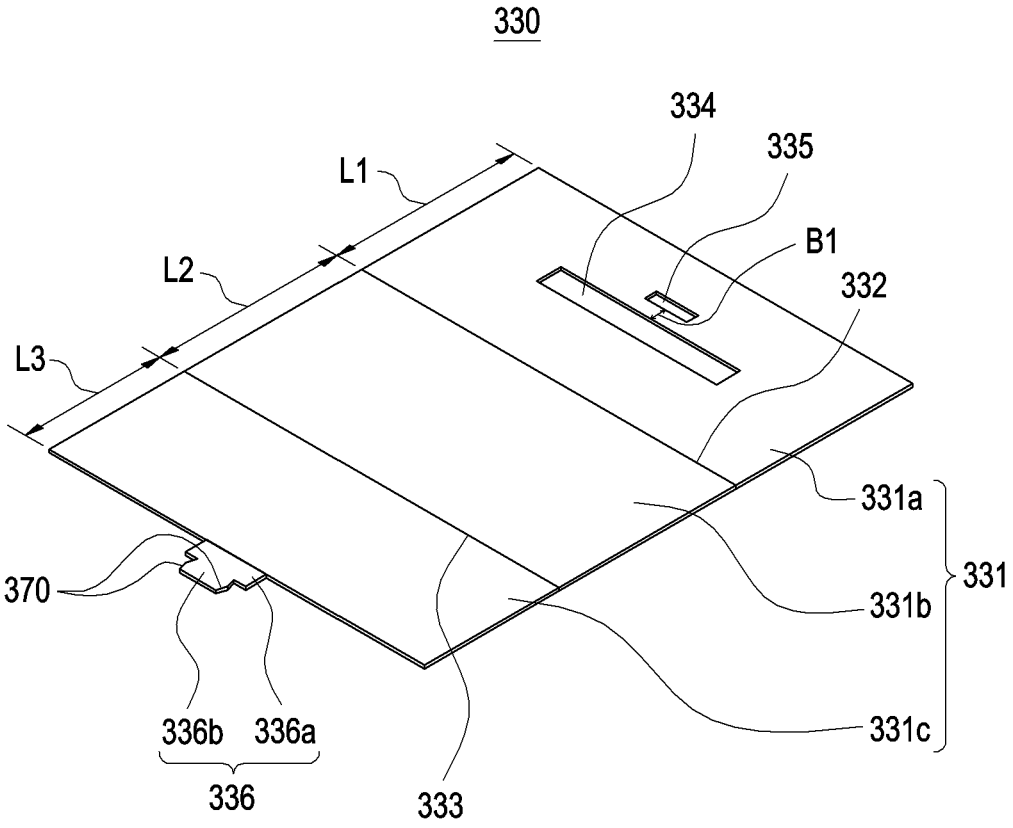
FIG. 10 is a perspective view illustrating a configuration of a supporting structure included in a packaging box of an electronic device, with a speaker positioned on a bottom, according to other various embodiments of the disclosure.
Figure 11:
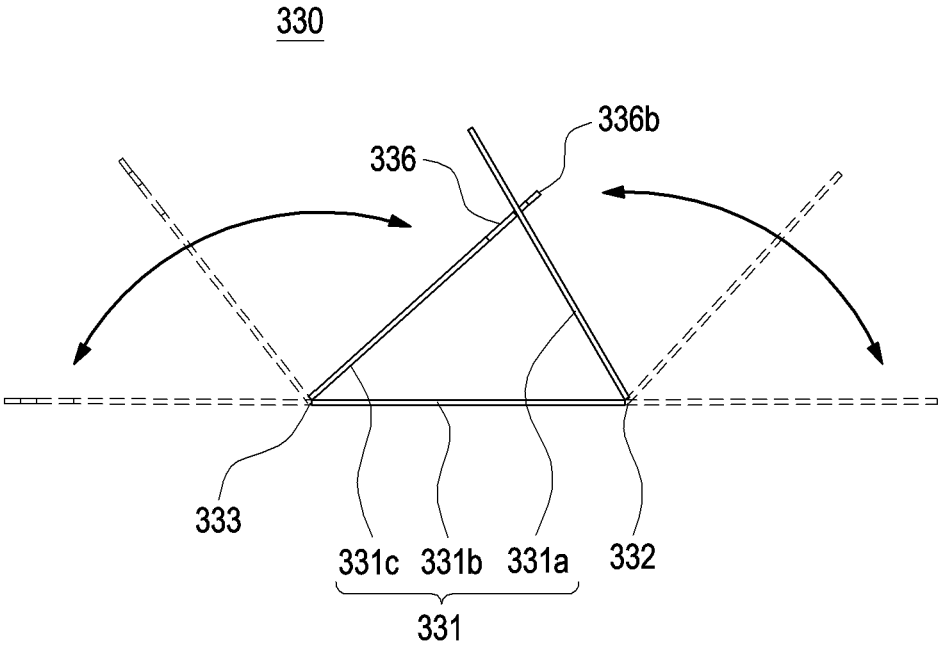
FIG. 11 is a side view illustrating a process of folding a supporting structure included in a packaging box of an electronic device, with a speaker positioned on a bottom, according to other various embodiments of the disclosure.

FIG. 10 is a perspective view illustrating a configuration of a supporting structure 330 included in a packaging box (e.g., 300 of FIG. 13) of an electronic device (e.g., 100 of FIG. 13), with a speaker (e.g., 100*b* of FIG. 13) positioned on a bottom, according to other various embodiments of the disclosure. FIG. 11 is a side view illustrating a process of folding a supporting structure 330 included in a packaging box (e.g., 300 of FIG. 13) of an electronic device (e.g., 100 of FIG. 13), with a speaker (e.g., 100*b* of FIG. 13) positioned on a bottom, according to other various embodiments of the disclosure.

Figure 15:
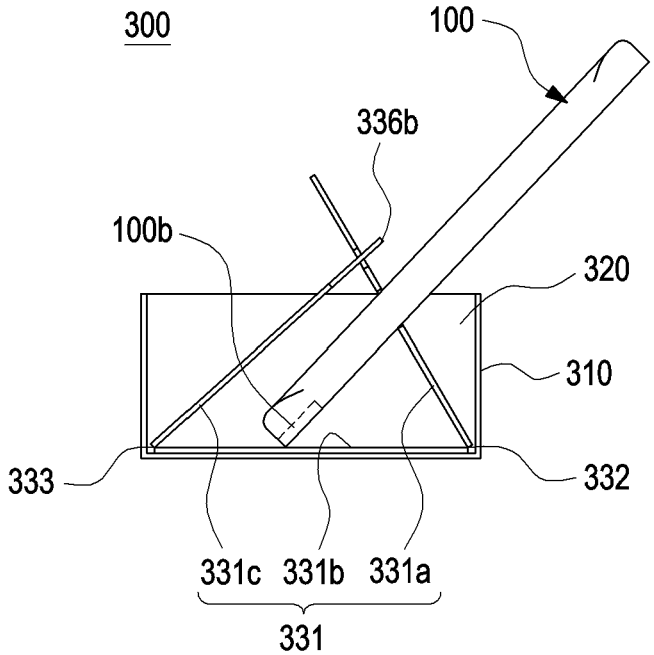
FIG. 15 is a side cross-sectional view illustrating a state of being received in a packaging box when a supporting structure is used for sound amplification, according to other various embodiments of the disclosure.

Referring to FIGS. 10 and 11, according to various embodiments, a speaker (e.g., 100*b* of FIG. 13) may be positioned on the bottom of the electronic device (e.g., 100 of FIG. 15). A packaging box (e.g., 300 of FIG. 13) of the electronic device (e.g., 100 of FIG. 13) may include a packaging box body (e.g., 310 of FIG. 13) and/or a supporting structure 330. For example, in the packaging box body (e.g., 310 of FIG. 13), the supporting structure 330 or various accessories (not shown) of the electronic device 100 may be packaged, and the receiving part (e.g., 320 of FIG. 13) may receive the electronic device (e.g., 100 of FIG. 13) and/or the supporting structure 330. The supporting structure 330 may be included in the receiving part (e.g., 320 of FIG. 13) to be folded or unfolded to amplify the sound from the speaker (e.g., 100*b* of FIG. 13) included on the bottom of the electronic device (e.g., 100 of FIG. 13) or to cradle the electronic device (e.g., 100 of FIG. 13). The speaker (e.g., 100*b* of FIG. 13) may be positioned on the bottom of the electronic device (e.g., 100 of FIG. 13) or on a side surface/back surface of the electronic device (e.g., 100 of FIG. 13) of the electronic device (e.g., 100 of FIG. 13). In the instant embodiment described, the speaker (e.g., 100 of FIG. 13) is positioned on the bottom of the electronic device (e.g., 100 of FIG. 13).

The packaging box (e.g., 300 of FIG. 13) may be identical or similar in at least partial configuration to the above-described packaging box (e.g., 200 of FIG. 7). Thus, since the packaging box body (e.g., 310 of FIG. 13) and the receiving part (e.g., 320 of FIG. 13) among the components of the packaging box (e.g., 300 of FIG. 13) in the instant embodiment may easily be appreciated from the above-described embodiments, no detailed description thereof is given below.

As described above in connection with FIG. 10, the supporting structure 330 may include a supporting structure body 331, a first folding part 332 and a second folding part 333, a first coupling hole 334 and a second coupling hole 335, and a coupling part 336. For example, the supporting structure body 331 may be divided into a first portion 331*a*, a second portion 331*b*, and a third portion 331*c* by the first folding part 332 and the second folding part 333 described below. The first folding part 332 may be formed between the first portion 331*a* and the second portion 331*b* to be folded and unfolded as the first portion 331*a* and the second portion 331*b* are rotated. The second folding part 333 may be formed between the second portion 331*b* and the third portion 331*c* to be folded and unfolded as the second portion 331*b* and the third portion 331*c* are rotated.

Figure 13:
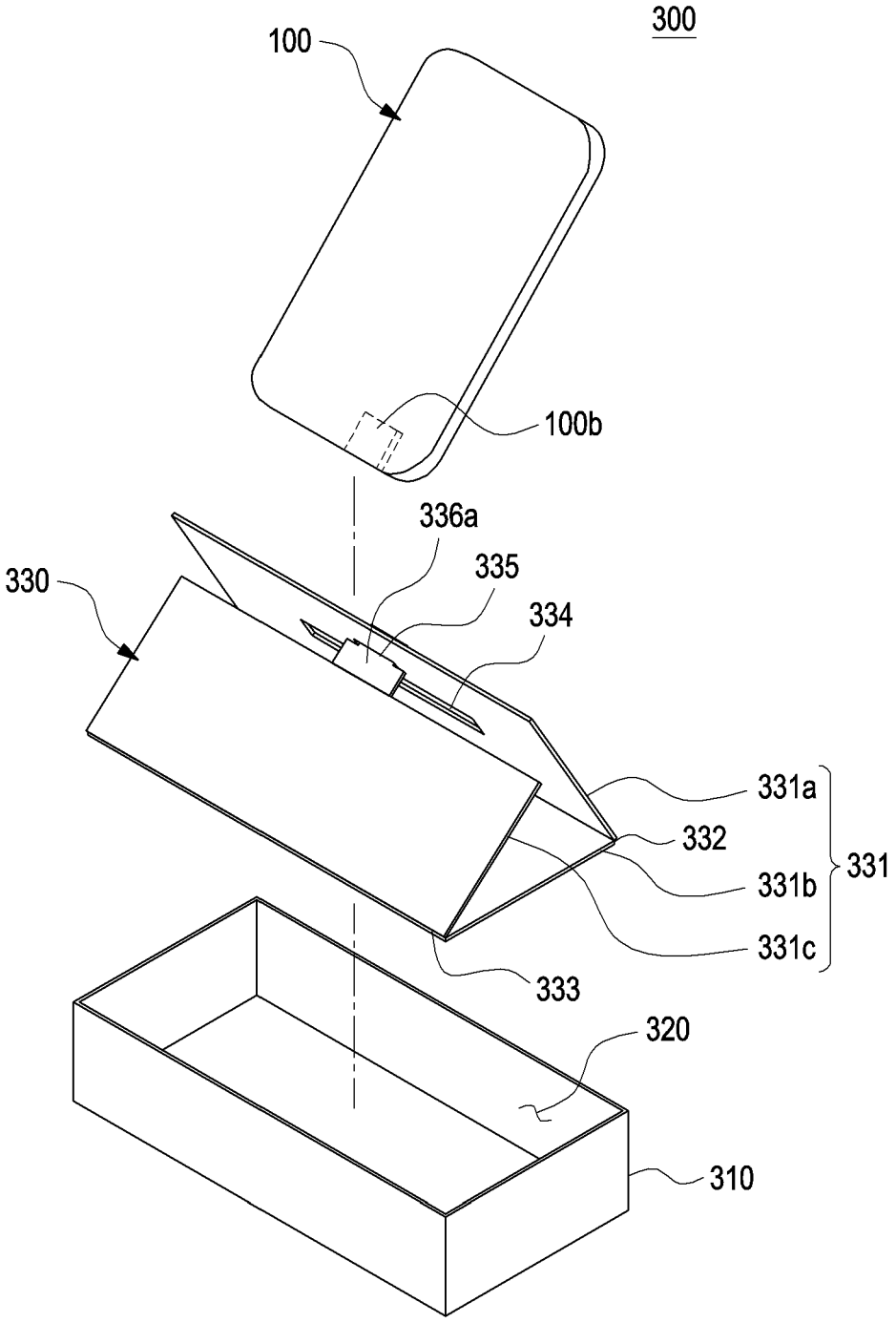
FIG. 13 is an exploded perspective view illustrating an example in which a supporting structure is received in a packaging box when used for sound amplification, according to other various embodiments of the disclosure.

The first coupling hole 334 may be formed in at least a portion of the first portion 331*a* to be able to couple or remove the electronic device (e.g., 100 of FIG. 13). The second coupling hole 335 may be formed in at least a portion of the first portion 331*a* to be coupled with the coupling part 336 described below. For example, the first coupling hole 334 and the second coupling hole 335 may be formed close to each other.

The coupling part 336 may be formed to project from at least an outer edge of the third portion 331*c* and be coupled to or removed from the second coupling hole 335 as the first portion 331*a* and the third portion 331*c* are rotated. For example, the coupling part 336 may be coupled to the second coupling hole 335 to allow the supporting structure 330 to be used to amplify the sound from the speaker (not shown) or to be used as a cradle.

As described above in connection with FIG. 10, the coupling part 336 may include a coupling body 336*a* and a coupling member 336*b*. The coupling member 336*b* may protrude from an outer edge of the coupling body 336*a* and be coupled to or removed from the second coupling hole 335. The coupling body 336*a* may protrude from at least an outer edge of the third portion 331*c* to support the coupling member 336*b* to be coupled to or removed from the second coupling hole 335.

According to an embodiment, as shown in FIG. 10, the supporting structure 330 may include the first portion 331*a*, the second portion 331*b*, or the third portion 331*c*. For example, the side width L1 of the first portion 331*a*, the side width L2 of the second portion 331*b*, or the side width L3 of the third portion 331*c* may be identical to or different from one another. For example, the side width L1 of the first portion 331*a*, the side width L2 of the second portion 331*b*, or the side width L3 of the third portion 331*c* may be identical to one another, or the side width L1 of the first portion 331*a*, the side width L2 of the second portion 331*b*, or the side width L3 of the third portion 331*c* may differ from one another.

In the instant embodiment, the side widths L1 and L2 of the first and second portions 331*a* and 331*b* may be identical to each other, and the side width L3 of the third portion 331*c* may be smaller than the side widths L1 and L2 of the first and second portions 331*a* and 331*b*.

As shown in FIGS. 10 and 11, when the coupling member 336*b* is coupled to the second coupling hole 335 in one surface of the first portion, it may protrude a predetermined length from the second coupling hole 335 in another surface of the first portion. In this case, anti-escaping members 370 may be formed slantedly in both ends of the coupling member 336*b* to prevent it from escaping off the second coupling hole 335. For example, if the coupling member 336*b* is coupled to the second coupling hole 335, the anti-escaping members 370 may be stuck to the second coupling hole 335, preventing it from escaping off the second coupling hole 335. The configuration of the anti-escaping member 370 is described below with reference to FIGS. 12A and 12B.

Figure 12A:
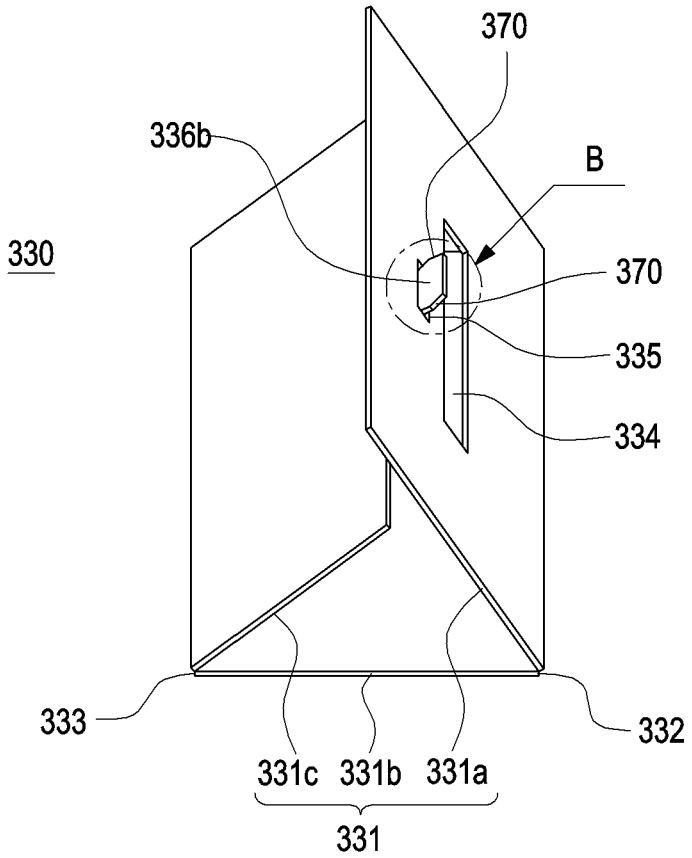
FIG. 12A is a perspective view illustrating a folded state of a supporting structure included in a packaging box of an electronic device, with a speaker positioned on a bottom, according to other various embodiments of the disclosure.
Figure 12B:
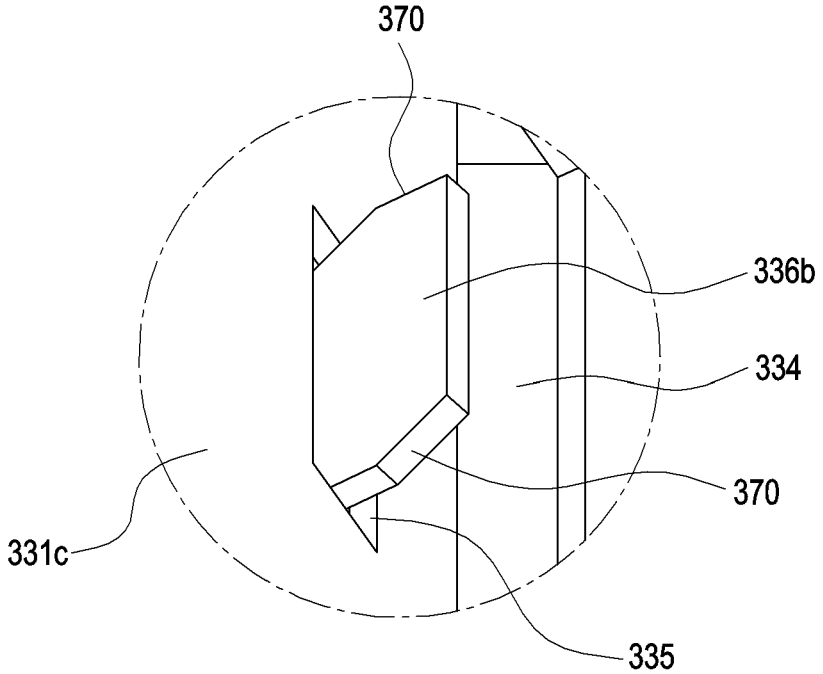
FIG. 12B is an enlarged, perspective view of portion B of FIG. 12A.

FIG. 12A is a perspective view illustrating a folded state of a supporting structure 330 included in a packaging box of an electronic device (e.g., 100 of FIG. 13), with a speaker (e.g., 100*b* of FIG. 13) positioned on a bottom, according to other various embodiments of the disclosure. FIG. 12B is an enlarged, perspective view of portion B of FIG. 12A.

Referring to FIGS. 12A and 12B, the first portion 331*a* and the second portion 331*b* may be rotated, around the first folding part 332, into a position slanted from each other, and the second portion 331*b* and/or the third portion 331*c* may be rotated into a position slanted from each other, around the second folding part 333 formed between the second portion 331*b* and the third portion 331*c*. In this case, the coupling part 336 formed in at least a portion of the third portion 331*c* may be rotated by the second folding part 333 to be coupled to the second coupling hole 335. Since the coupling part 336 includes the coupling member 336*b* projecting a predetermined length to another surface of the first portion when coupled to the second coupling hole 335, if the coupling part 336 is coupled to the second coupling hole 335, the coupling member 336*b* of the coupling part 336 may be projected a predetermined length from the second coupling hole 335 on the other surface of the first portion.

Simultaneously, the anti-escaping member 370 of the coupling member 336*b* may interfere with the other surface of the first portion around the second coupling hole 335, preventing the coupling member 336*b* from escaping off the second coupling hole 335. The anti-escaping member 370 may be projected a predetermined length from the second coupling hole 335 while being simultaneously stuck to the second coupling hole 335.

FIG. 13 is an exploded perspective view illustrating an example in which a supporting structure 330 is received in a packaging box when used for sound amplification, according to other various embodiments of the disclosure.

Referring to FIG. 13, in the supporting structure 330 with the first, second, and third portions folded slanted from one another, the second portion 331*b* may be positioned to face the bottom of the packaging box body 310, and the first portion 331*a* and the third portion 331*c* may be slanted from each other, forming a triangular shape. The electronic device 100 may be coupled to the first coupling hole 334 of the folded supporting structure 330. In this state, the supporting structure 330, along with the electronic device 100, may be received in the receiving part 320 of the packaging box body 310. At this time, the bottom of the supporting structure 330 in the triangular shape may be disposed to face the bottom surface of the receiving part 320, and the top of the triangular supporting structure 330 may be positioned over the receiving part 320.

Figure 14:
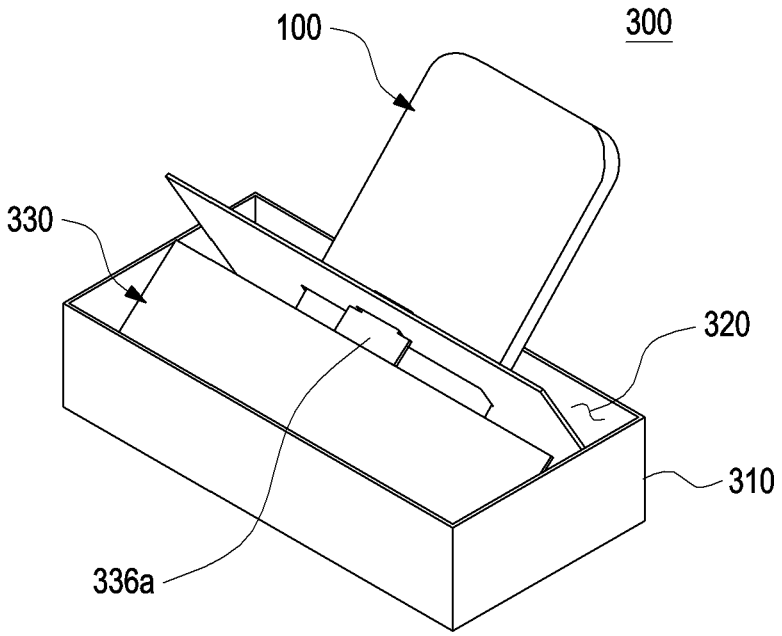
FIG. 14 is a perspective view illustrating a state of being received in a packaging box when a supporting structure is used for sound amplification, according to other various embodiments of the disclosure.
Figure 16:
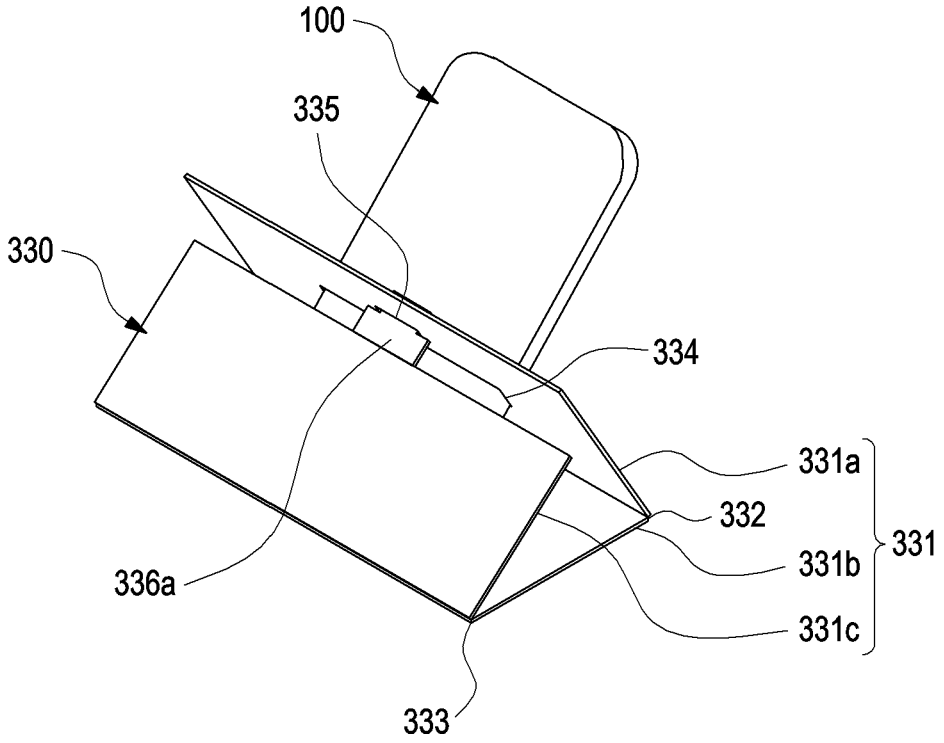
FIG. 16 is a perspective view illustrating a state in which a supporting structure is used as a cradle according to other various embodiments of the disclosure.

FIG. 14 is a perspective view illustrating a state of being received in a packaging box 300 when a supporting structure 330 is used for sound amplification, according to other various embodiments of the disclosure. FIG. 15 is a side cross-sectional view illustrating a state of being received in a packaging box when a supporting structure 330 is used for sound amplification, according to other various embodiments of the disclosure. FIG. 16 is a perspective view illustrating a state in which a supporting structure 330 is used as a cradle according to other various embodiments of the disclosure.

Referring to FIGS. 14, 15 and 16, in the folded supporting structure 330, the electronic device 100 may be coupled to the first coupling hole 334, and the electronic device 100 may be coupled to the first coupling hole 334 in an upright position along the length direction of the packaging box body 310. For example, the electronic device 100 may be cradled in a slanted state in the receiving part 320, while being supported by the supporting structure 330 or the first coupling hole 334. In this state, it may be received in the receiving part 320 of the packaging box body 310 to amplify the sound from the speaker 100*b* positioned on the bottom of the electronic device 100. The supporting structure 330 may be received in the length direction of the packaging box body 310 and support the electronic device 100, which stands perpendicular to the length direction, in a position tilted backward. As shown in FIG. 15, the supporting structure 330 may support the electronic device 100 to be received in the receiving part 320 of the packaging box body 310.

In this state, the speaker 100*b* of the electronic device 100 may be positioned on the bottom so that the sound is amplified in the space formed by the first portion 331*a*, second portion 331*b*, or third portion 331*c* of the supporting structure 330. If the speaker 100*b* positioned on the bottom of the electronic device 100 outputs a sound, the output sound may be reflected and amplified in the receiving part 320 of the packaging box body 310. For example, the sound output from the speaker 100*b* may be reflected by the inner wall of the packaging box body 310, and the reflected sound may be reflected by the supporting structure 330 or travel along a space formed by the supporting structure 330. As such, the sound may be amplified while traveling along the shape or space of the supporting structure 330.

As such, the sound output from the speaker 100*b* positioned on the bottom of the electronic device 100 may be reflected and amplified by the supporting structure 330 or the inner surface of the receiving part 320 of the packaging box body 310. Thus, the output sound may be amplified in its mid-bass band, and rich bass band amplification may be achieved. Further, since the supporting structure 330 may be used to amplify the sound from the speaker (e.g., 100*b* of FIG. 15) positioned on the bottom of the electronic device 100 as shown in FIG. 16 and may be used as a cradle for the electronic device 100 coupled to the first coupling hole 334 of the first portion 331*a*, the user may listen to music or watch video via the electronic device 100 cradled on the supporting structure 330.

As such, not only does the packaging box 300 package the electronic device 100, but the packaging box 300 may amplify the sound from the speaker (not shown) of the electronic device 100 using the supporting structure 330 or be used as a cradle for the electronic device 100. Thus, since the packaging box 300 may perform various functions, the usability of the packaging box may further be enhanced.

Figure 17:
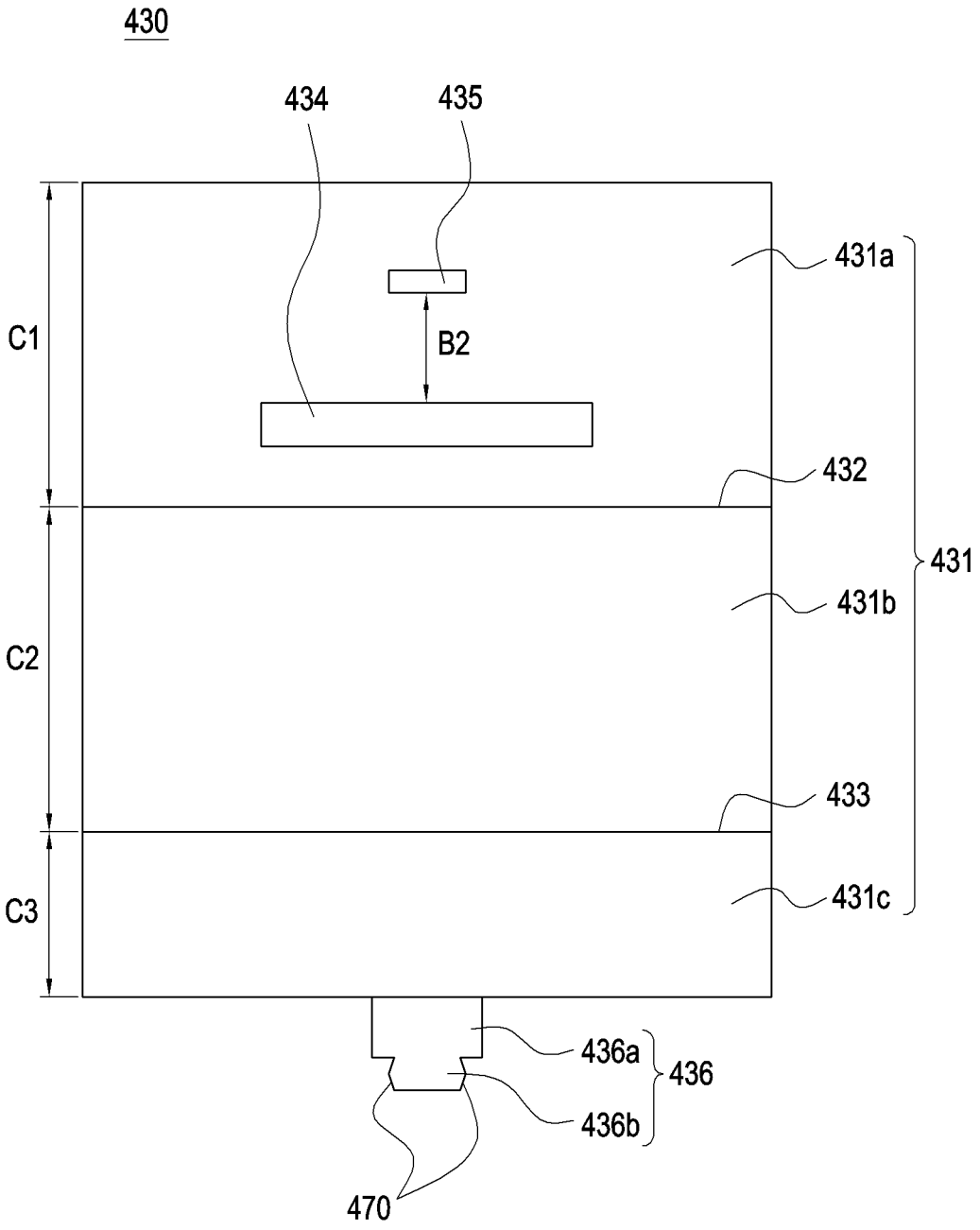
FIG. 17 is a plan view illustrating another example supporting structure included in a packaging box of an electronic device, with a speaker positioned on a bottom, according to other various embodiments of the disclosure.
Figure 18:
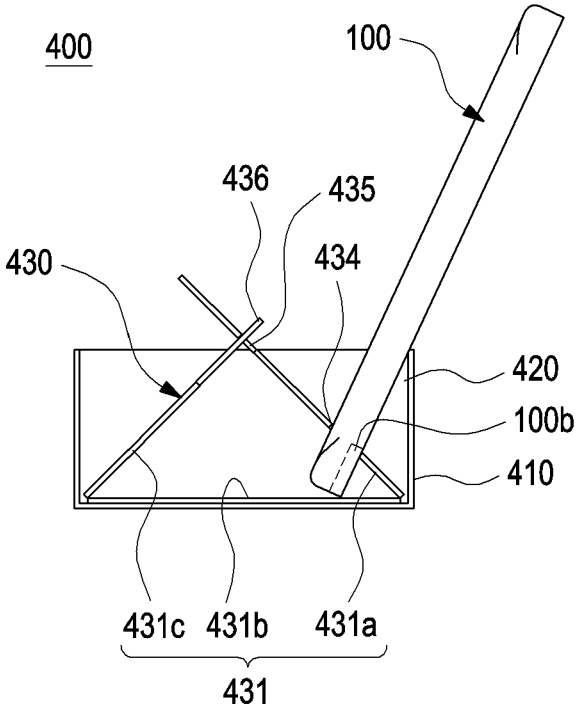
FIG. 18 is a side cross-sectional view illustrating another example supporting structure included in a packaging box of an electronic device, with a speaker positioned on a bottom, according to other various embodiments of the disclosure.

FIG. 17 is a plan view illustrating another example supporting structure included in a packaging box (e.g., 400 of FIG. 18) of an electronic device (e.g., 100 of FIG. 18), with a speaker (e.g., 100*b* of FIG. 18) positioned on a bottom, according to other various embodiments of the disclosure. FIG. 18 is a side cross-sectional view illustrating another example supporting structure included in a packaging box 400 of an electronic device 100, with a speaker 100*b* positioned on a bottom, according to various embodiments of the disclosure.

Referring to FIGS. 17 and 18, a supporting structure 430 may include a supporting structure body 431, a first folding part 432 and a second folding part 433, a first coupling hole 434 and a second coupling hole 435, and a coupling part 436. For example, the supporting structure body 431 may be divided into a first portion 431*a*, and a third portion 431*c* by the first folding part 432 and the second folding part 433 described below. The first folding part 432 may be formed between the first portion 431*a* and the second portion 431*b* to be folded and unfolded as the first portion 431*a* and the second portion 431*b* are rotated. The second folding part 433 may be formed between the second portion 431*b* and the third portion 431*c* to be folded and unfolded as the second portion 431*b* and the third portion 431*c* are rotated. The supporting structure 430 may include a first portion 431*a*, a second portion 431*b*, or a third portion 431*c*. For example, the side width C1 of the first portion 431*a*, the side width C2 of the second portion 431*b*, or the side width C3 of the third portion 431*c* may be identical to or different from one another. For example, the side width C1 of the first portion 431*a*, the side width C2 of the second portion 431*b*, or the side width C3 of the third portion 431*c* may be identical to one another, or the side width C1 of the first portion 431*a*, the side width C2 of the second portion 431*b*, or the side width C3 of the third portion 431*c* may differ from one another.

In the instant embodiment, the side widths C1 and C2 of the first and second portions 431*a* and 431*b* may be identical to each other, and the side width C3 of the third portion 431*c* may be smaller than the side widths C1 and C2 of the first and second portions 431*a* and 431*b*.

According to an embodiment, the first portion 431*a* and the second portion 431*b* of the supporting structure 430 may be rotated, around the first folding part 432 formed between the first portion 431*a* and the second portion 431*b*, into a position slanted from each other, and the second portion 431*b* and the third portion 431*c* may be rotated into a position slanted from each other, around the second folding part 433 formed between the second portion 431*b* and the third portion 431*c*. In this case, the coupling member 436*b* of the coupling part 436 formed in at least a portion of the third portion 431*c* may be rotated to be coupled to the second coupling hole 435. Simultaneously, the anti-escaping member 470 of the coupling member 436*b* may be stuck to the second coupling hole 435, preventing it from escaping off the second coupling hole 435. The anti-escaping member 470 may be prevented from projecting beyond the predetermined length from the second coupling hole 435 while being simultaneously stuck to the second coupling hole 435.

In the folded supporting structure 430, the first portion 431*a* and the second portion 431*b* may be slanted from each other while forming a triangle. The electronic device 100 may be coupled to the first coupling hole 434 of the folded supporting structure 430. In the triangular supporting structure 430, the side width C1 of the first portion 431*a*, the side width C2 of the second portion 431*b*, or the side width C3 of the third portion 431*c* may be formed to differ from one another, so that the first portion 431*a* and the third portion 431*c* have the same or different tilt angles.

Thus, the angle at which the electronic device 100 coupled to the first coupling hole 434 of the supporting structure 430 is cradled may be varied.

According to an embodiment, in the supporting structure (e.g., 330 of FIG. 10), the first coupling hole (e.g., 334 of FIG. 10) and second coupling hole (e.g., 335 of FIG. 10) of the first portion (e.g., 331*a* of FIG. 10) may be formed to be close to or distant from each other. As described above in connection with FIG. 10, in the supporting structure 330, the first and second coupling holes 334 and 335 may be formed close to each other (B1). If the coupling part 336 of the third portion 331*c* is coupled to the second coupling hole 335 of the first portion 331*a* in the state, the supporting structure 330 may be shaped as a triangle as shown in FIG. 15, and the triangular supporting structure 330 may be formed so that the first and third portions 331*a* and 331*c* have different tilt angles. The electronic device (e.g., 100 of FIG. 15), may be slantedly coupled to the first coupling hole (e.g., 334 of FIG. 10). The folded supporting structure 330, along with the electronic device (e.g., 100 of FIG. 15), may be received in the receiving part 320 of the packaging box body 310. In this state, the sound output from the speaker (e.g., 100*b* of FIG. 15), positioned on the bottom of the slanted electronic device (e.g., 100 of FIG. 15), may be reflected and amplified by the supporting structure 330 or the inner surface of the receiving part 320 of the packaging box body 310. Thus, the output sound may be amplified in the mid-bass band of the speaker (e.g., 100*b* of FIG. 15) and rich bass band amplification may be achieved. Thus, the user may listen to high-quality sound.

According to an embodiment, as described above in connection with FIG. 17, in the supporting structure 430, the first coupling hole 434 of the first portion 431*a* and the second coupling hole 435 of the first portion may be formed to be distant from each other (B2). If the coupling part 436 of the third portion 431*c* is coupled to the second coupling hole 435 of the first portion 431*a* in the state as shown in FIG. 18, the supporting structure 430 may be shaped as a triangle, and the triangular supporting structure 430 may be formed so that the first and third portions 431*a* and 431*c* have the same tilt angle. The electronic device 100 may be slantedly coupled to the first coupling hole 434. In this case, the electronic device 100 may be coupled in a position in which the electronic device stands more upright than the tilt angle of the electronic device (e.g., 100 of FIG. 15). The folded supporting structure 430, along with the electronic device 100, may be received in the receiving part 420 of the packaging box body 410. In other words, the electronic device 100 may be received, slanted more upright than the electronic device (e.g., 100 of FIG. 15). Thus, the position of the speaker (e.g., 100*b* of FIG. 18) positioned on the bottom of the electronic device 100 may be varied and, thus, the sound output from the speaker (e.g., 100*b* of FIG. 18) may be reflected and further amplified by the supporting structure 430 or the inner surface of the receiving part 420 of the packaging box body 410. Thus, the output sound may be amplified in its mid-bass band and rich bass band amplification may be achieved. Thus, the user may listen to high-quality sounds.

Figure 19:
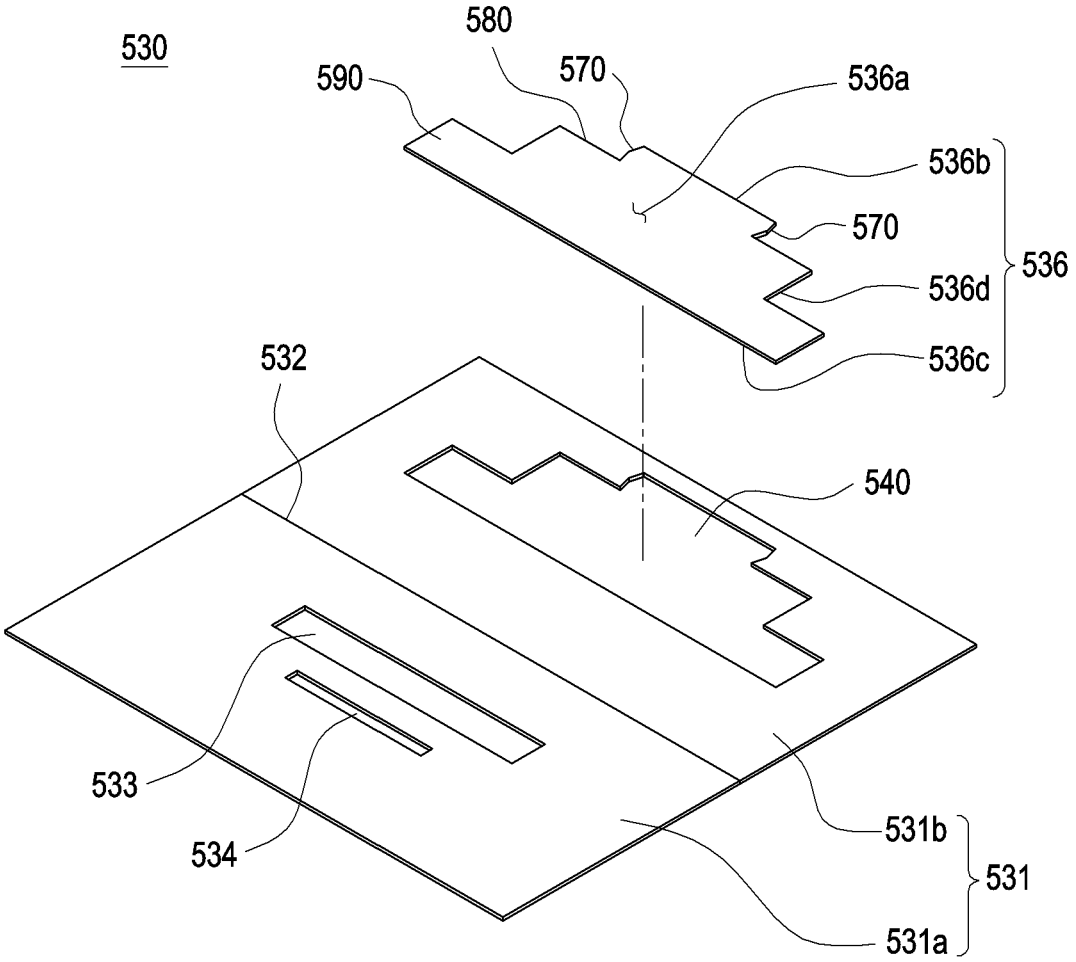
FIG. 19 is an exploded perspective view illustrating a configuration of a supporting structure included in a packaging box of an electronic device, with a speaker positioned on a bottom, according to yet other various embodiments of the disclosure.
Figure 20:
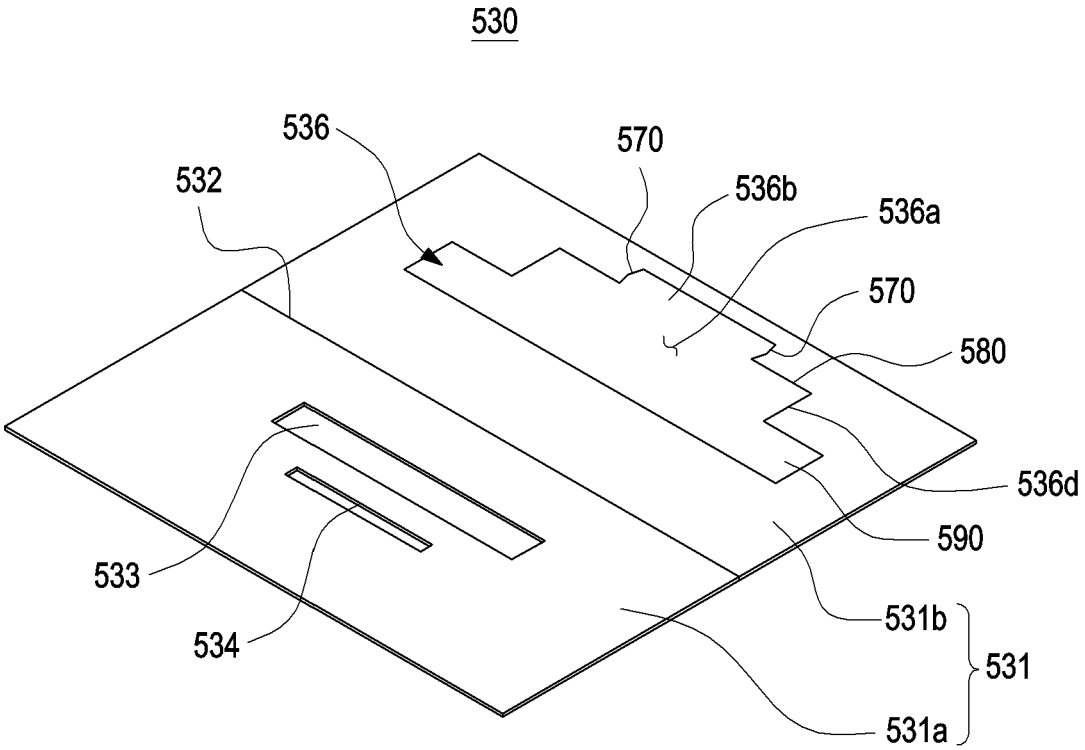
FIG. 20 is a perspective view illustrating a combined state of a supporting structure included in a packaging box of an electronic device, with a speaker positioned on a bottom, according to yet other various embodiments of the disclosure.

FIG. 19 is an exploded perspective view illustrating a configuration of a supporting structure 530 included in a packaging box (e.g., 500 of FIG. 23) of an electronic device (e.g., 100 of FIG. 23), with a speaker (e.g., 100*b* of FIG. 24) positioned on a bottom, according to yet other various embodiments of the disclosure. FIG. 20 is a perspective view illustrating a combined state of a supporting structure 530 included in a packaging box of an electronic device, with a speaker (e.g., 100*b* of FIG. 24) positioned on a bottom, according to yet other various embodiments of the disclosure.

Referring to FIGS. 19 and 20, according to various embodiments, a packaging box (e.g., 500 of FIG. 23) of an electronic device (e.g., 100 of FIG. 23) may include a packaging box body (e.g., 510 of FIG. 23), a receiving part (e.g., 520 of FIG. 23), and/or a supporting structure 530. For example, in the packaging box body (e.g., 510 of FIG. 23), the supporting structure 530 or various accessories (not shown) of the electronic device (e.g., 100 of FIG. 23) may be packaged, and the receiving part (e.g., 520 of FIG. 23) may receive the electronic device (e.g., 100 of FIG. 23) or the supporting structure 530.

The packaging box (e.g., 500 of FIG. 23) may be identical or similar in at least partial configuration to the above-described packaging box (e.g., 200 of FIG. 7). Thus, since the packaging box body (e.g., 510 of FIG. 23) and the receiving part (e.g., 520 of FIG. 23) among the components of the packaging box (e.g., 500 of FIG. 23) may easily be appreciated from the above-described embodiments, no detailed description thereof is given below.

Figure 23:
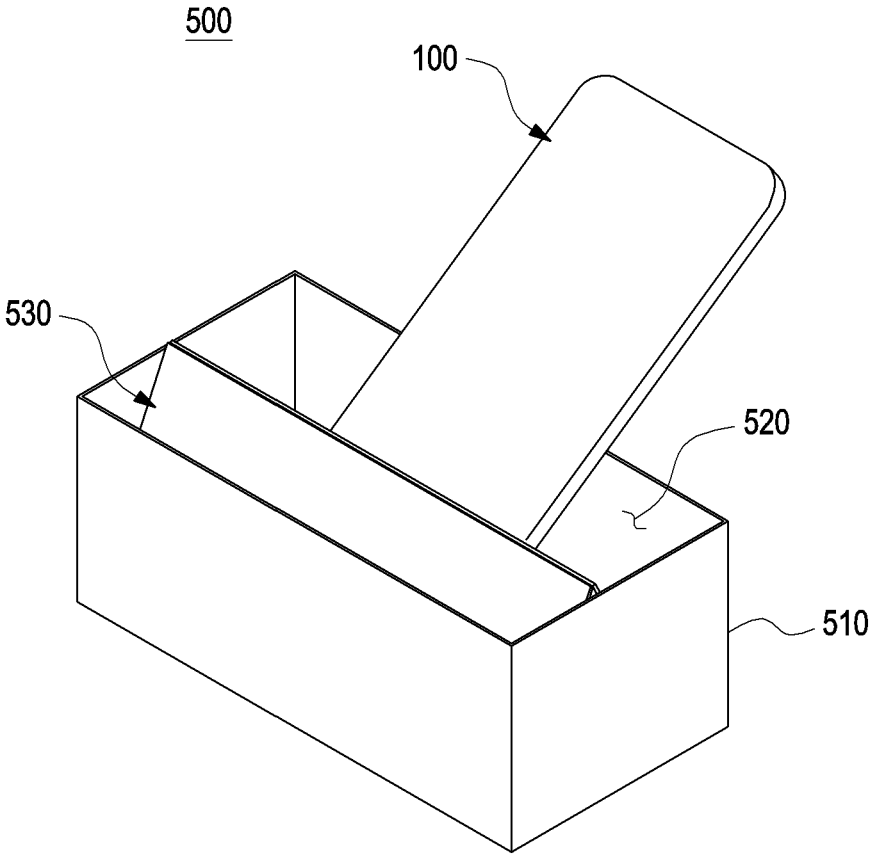
FIG. 23 is a perspective view illustrating a state in which an electronic device is coupled to a first coupling hole when a supporting structure is used for sound amplification according to yet other various embodiments of the disclosure.

As described above in connection with FIGS. 19 and 20, the supporting structure 530 may be included in the receiving part (e.g., 520 of FIG. 23) to be folded or unfolded to amplify the sound from the speaker (e.g., 100*b* of FIG. 24) included in the electronic device (e.g., 100 of FIG. 23) or to cradle the electronic device (e.g., 100 of FIG. 23). For example, the supporting structure 530 may include a supporting structure body 531, a folding part 532, a first coupling hole 533 and a second coupling hole 534, and a coupling part 536. The supporting structure body 531 may be divided into a first portion 531*a* and a second portion 531*b* by the folding part 532 described below. The folding part 532 may be formed between the first portion 531*a* and the second portion 531*b* to be folded and unfolded as the first portion 531*a* and the second portion 531*b* are rotated. For example, the first and second portions 531*a* and 531*b* may be rotated around the folding part and be folded in a position slanted from each other.

The first coupling hole 533 may be formed in at least a portion of the first portion 531*a* to be able to couple or remove the electronic device (e.g., 100 of FIG. 23). The second coupling hole 534 may be formed in at least a portion of the first portion 531*a* to be coupled with the coupling part 536 described below. For example, the first coupling hole 533 and the second coupling hole 534 may be formed close to each other.

The coupling part 536 may be coupled to or removed from the second coupling hole 534 as rotated in the cut portion 540 formed in at least a portion inside the second portion 531*b*. For example, when the coupling part 536 is rotated in the cut portion 540 and is coupled to the second coupling hole 534, the first portion 531*a* and the second portion 531*b* may be folded in triangle, and the supporting structure 530 folded in triangle may be used to amplify the sound from the speaker (e.g., 100*b* of FIG. 24) or as a cradle.

As described above in connection with FIGS. 19 and 20, the coupling part 536 may include a coupling body 536*a*, a coupling member 536*b*, a rotation part 536*c*, and/or a support 536*d*. For example, the coupling body 536*a* may include the coupling member 536*b*, the rotation part 536*c*, and/or the support 536*d* described below. As rotated, the coupling member 536*b* may be coupled to or removed from the cut portion 540. The rotation part 536*c* may be formed in at least a portion of the coupling member 536*b* to rotate the coupling member 536*b* to couple the coupling member 536*b* to the cut portion 540 or remove the coupling member 536*b* from the cut portion 540.

In this case, since anti-escaping members 570 are formed in both ends of the coupling member 536*b* to prevent it from escaping off the second coupling hole 534, if the coupling member 536*b* is inserted to the second coupling hole 534, the anti-escaping members 570 may be stuck to the second coupling hole 534, preventing it from escaping from the second coupling hole 534.

At least one latching jaw 580 may be formed on the bottom surface of the anti-escaping member 570 to get it stuck to the second coupling hole 534. A connection part 590 may be included between the rotation part 536*c* and the at least one latching jaw 580 to connect the rotation part 536*c* with the latching jaw 580. The at least one latching jaw 580 may be stuck to the second coupling hole 534 while simultaneously supporting the anti-escaping member 570 to prevent it from escaping from the second coupling hole 534.

The at least one latching jaw 580 and the support 536*d* may be formed on the bottom surface of the coupling member 536*b* and be formed to extend from the coupling member 536*b* in the length direction of the supporting structure 530. The connection part 590 may be formed on the bottom surface of the support 536*d* and be formed to extend from the support 536*d* in the length direction. For example, the at least one latching jaw 580 and the support 536*d* may be formed to be larger than the anti-escaping member 570, and the connection part 590 may be formed to be larger than the at least one latching jaw 580 and the support 536*d*. Thus, the coupling part 536 allows the coupling member 536*b*, the support 536*d*, and the connection part 590 to be formed in different sizes. For example, the coupling part 536 may be formed in a step shape as shown in FIG. 19.

Figure 21:
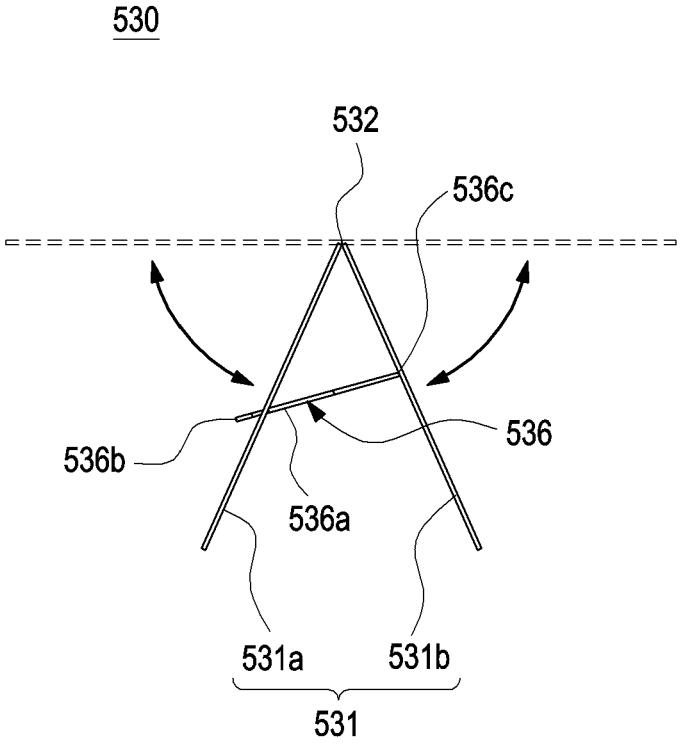
FIG. 21 is a side view illustrating a process of folding a supporting structure included in a packaging box of an electronic device, with a speaker positioned on a bottom, according to yet other various embodiments of the disclosure.
Figure 22:
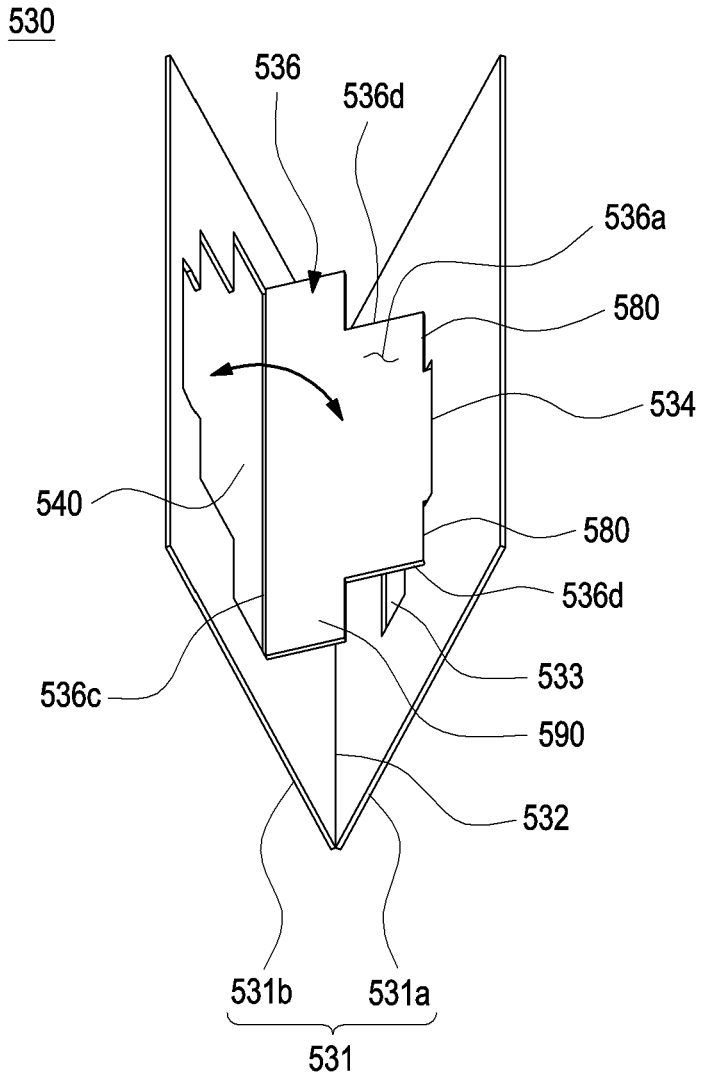
FIG. 22 is an internal perspective view illustrating a folded state of a supporting structure included in a packaging box of an electronic device, with a speaker positioned on a bottom, according to yet other various embodiments of the disclosure.

FIG. 21 is a side view illustrating a process of folding a supporting structure 530 included in a packaging box of an electronic device, with a speaker (e.g., 100*b* of FIG. 24) positioned on a bottom, according to yet other various embodiments of the disclosure. FIG. 22 is an internal perspective view illustrating a folded state of a supporting structure 530 included in a packaging box of an electronic device, with a speaker (e.g., 100*b* of FIG. 24) positioned on a bottom, according to yet other various embodiments of the disclosure.

Referring to FIGS. 21 and 22, the first portion 531*a* and the second portion 531*b* of the supporting structure 530 may be rotated around the folding part 532 formed between the first portion 531*a* and the second portion 531*b* into a position slanted from each other. In this case, the coupling part 536 formed in at least a portion of the second portion 531*b* may be rotated by the folding part 532 and, together with it, the coupling member 536*b* of the coupling part 536 may be rotated to be coupled to the second coupling hole 534 of the first portion. Simultaneously, the anti-escaping member 570 of the coupling member 536*b* may be stuck to the second coupling hole 534, preventing the coupling member 536*b* from escaping off the second coupling hole 535. The anti-escaping member 570 may be projected a predetermined length from the second coupling hole 534 while being simultaneously stuck to the second coupling hole 534.

FIG. 23 is a perspective view illustrating a state in which an electronic device is coupled to a first coupling hole (e.g., 533 of FIG. 19) when a supporting structure 530 is used for sound amplification according to yet other various embodiments of the disclosure.

Referring to FIG. 23, the electronic device 100 may be coupled to the first coupling hole (e.g., 533 of FIG. 19) of the folded supporting structure 530. The speaker (e.g., 100*b* of FIG. 24) may be positioned on the bottom of the electronic device 100. The speaker (e.g., 100*b* of FIG. 24) may be positioned on the bottom of the electronic device 100 or on a side surface/back surface of the electronic device 100. In the instant embodiment described, the speaker (e.g., 100*b* of FIG. 24) is positioned on the bottom of the electronic device 100.

According to an embodiment, the supporting structure 530, along with the electronic device 100, may be received in the receiving part 520 of the packaging box body 510. As the electronic device 100 is coupled to the first coupling hole (e.g., 533 of FIG. 19), an end of the electronic device 100 may simultaneously be positioned inside the supporting structure 530. The supporting structure 530 may be received in the length direction of the packaging box body 510 and support the electronic device 100, which stands perpendicular to the length direction, in a position tilted backward. Thus, the supporting structure 530 may allow the electronic device 100 to be cradled while simultaneously being coupled to the first coupling hole (e.g., 533 of FIG. 19). The supporting structure 530, along with the electronic device 100, may be received in the receiving part 520 of the packaging box body 510 while simultaneously cradling the electronic device 100.

In this state, if a sound is output from the speaker (e.g., 100*b* of FIG. 24) positioned on the bottom of the electronic device 100, the output sound may be spread inside the supporting structure 530 while being simultaneously reflected and amplified by the inner surface of the supporting structure 530. For example, the sound output from the speaker (e.g., 100*b* of FIG. 24) may be reflected by the inner wall of the supporting structure 530, and the reflected sound may come out of the supporting structure 530 and be reflected by the inner wall surface of the receiving part 520 of the packaging box body 510. As such, the sound may be amplified while traveling along the internal shape or space of the supporting structure 530.

Thus, in the state cradled in the receiving part, the electronic device 100 may amplify the sound from the speaker (e.g., 100*b* of FIG. 24) positioned on the bottom of the electronic device 100 using the supporting structure 530, and the user may watch video via the display of the electronic device 100.

Figure 24:
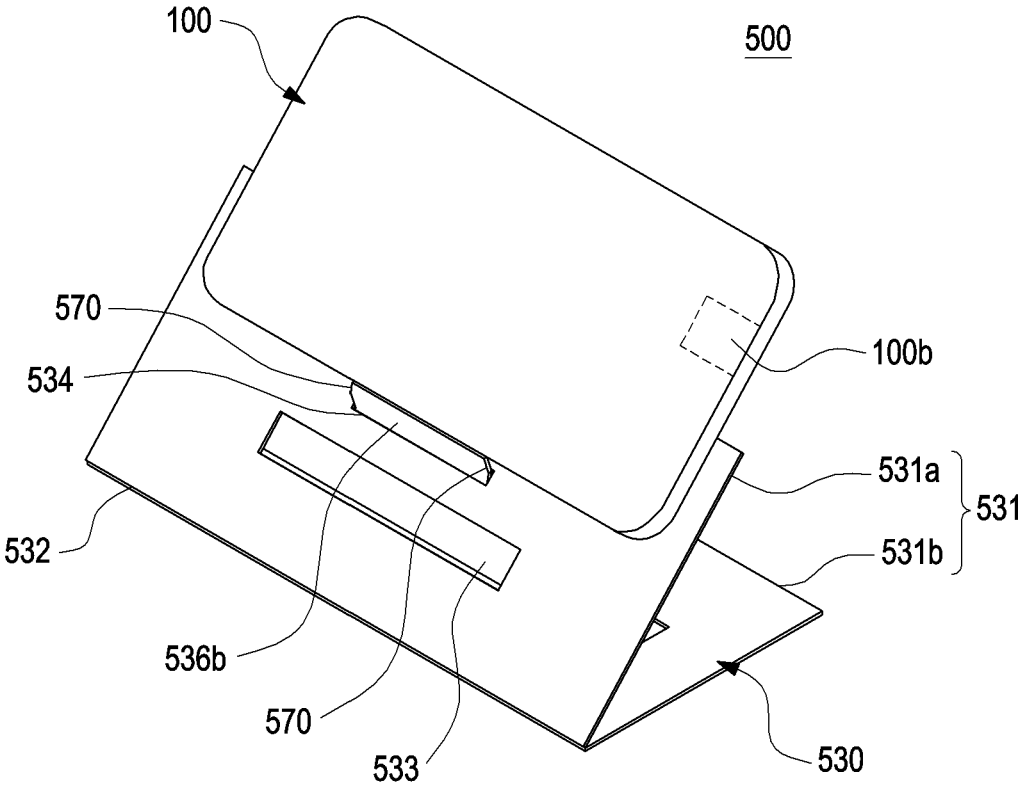
FIG. 24 is a perspective view illustrating a state in which a supporting structure is used as a cradle according to yet other various embodiments of the disclosure.

FIG. 24 is a perspective view illustrating a state in which a supporting structure 530 is used as a cradle according to yet other various embodiments of the disclosure.

Referring to FIG. 24, when removed from the receiving part (e.g., 520 of FIG. 23) of the packaging box body (e.g., 510 of FIG. 23), the folded supporting structure 530 may be used as a cradle for the electronic device 100. For example, the folded supporting structure 530 may be removed from the receiving part (e.g., 520 of FIG. 23), and the second portion 531*b* may be positioned to face the bottom surface while the first portion 531*a* may be simultaneously formed slantedly. At this time, since the second coupling hole 534 is formed in the slanted first portion 531*a*, the coupling member 536*b* of the coupling part 536 may be projected a predetermined length from the first portion 531*a* while being simultaneously coupled to the second coupling hole 534. The electronic device 100 may be placed and cradled on the projected coupling member 536*b*. In this state, the user may listen to music or watch video via the electronic device 100 cradled on the supporting structure 530.

As such, the packaging box 500 may be used to cradle the electronic device, as well as to amplify the sound from the speaker 100*b* positioned on the bottom of the electronic device 100 using the supporting structure 530. Thus, since the packaging box 500 may perform various functions, the usability of the packaging box may further be enhanced.

Figure 25:
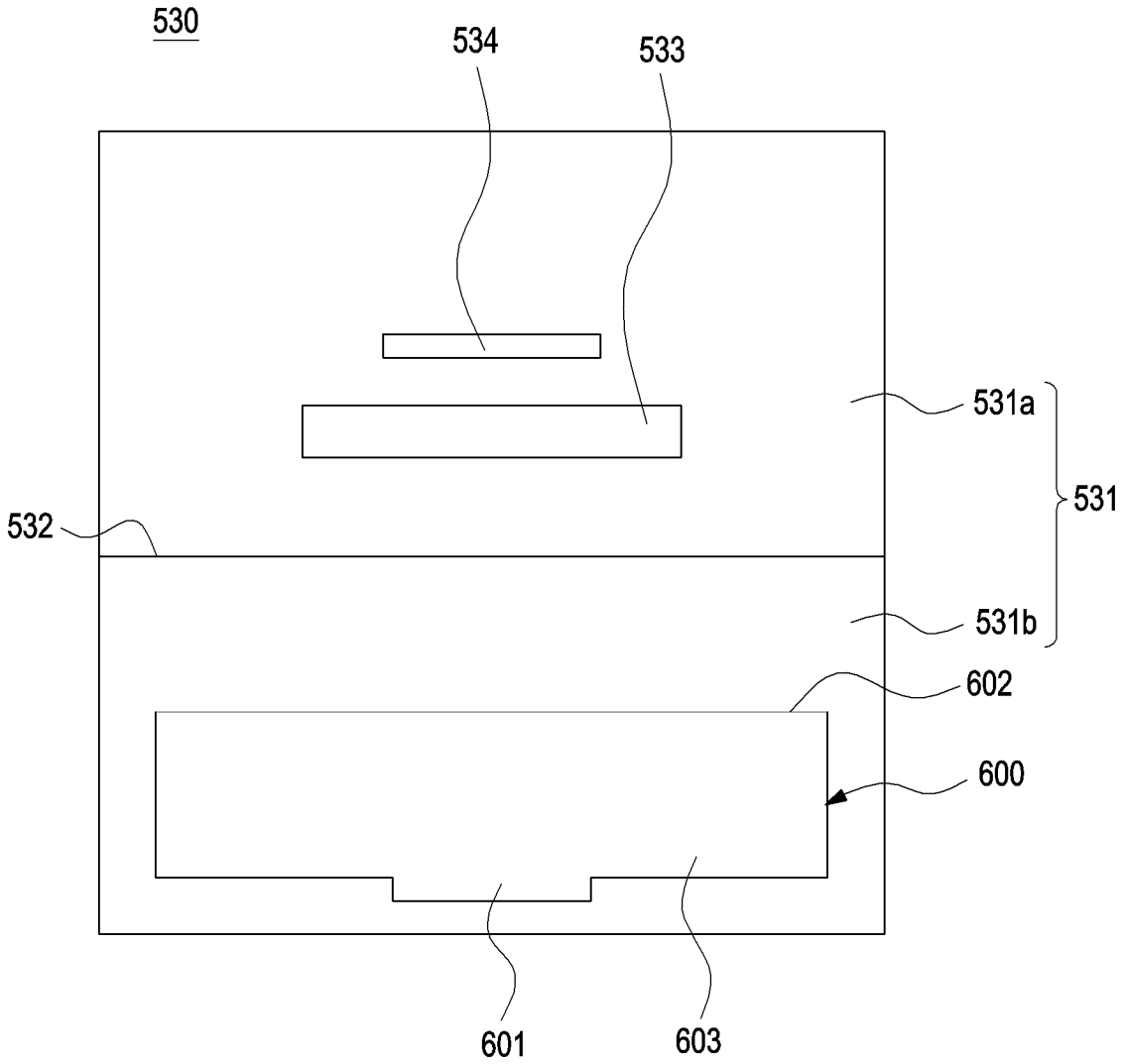
FIG. 25 is a plan view illustrating another example coupling part among components of a supporting structure according to yet other various embodiments of the disclosure.

FIG. 25 is a plan view illustrating another example coupling part among components of a supporting structure according to yet other various embodiments of the disclosure.

Referring to FIG. 25, the coupling part 600 may be included in a rectangular shape. For example, the coupling part 600 may include a coupling protrusion 601 coupled to and/or removed from a second coupling hole 534 included in the supporting structure 530 and a support 603 may be included between the coupling protrusion 601 and the rotation part 602 of the coupling part 600 to support the coupling protrusion 601. For example, the support 603 may be formed on the top surface of the support 603, and the rotation part 602 may be formed on the bottom of the support 603. The rotation part 602 may enable the coupling protrusion 601 and the support 603 to rotate. The coupling protrusion 601 and the support 603 may be shaped as a rectangle.

In the instant embodiment, the shape of the coupling protrusion 601 and the support 603 is a rectangular shape, but is not limited thereto. For example, the coupling protrusion 601 and the support 603 may have other various shapes in which they may be coupled to or removed from the second coupling hole 534. For example, the coupling protrusion 601 and the support 603 may have a square shape, and the coupling part 600 may have a square shape.

Thus, the shape of the coupling protrusion 601 allows for easier coupling or removal to/from the second coupling hole 534.

As such, if a sound is output from the speaker (e.g., 100*b* of FIG. 24) positioned on the bottom of the electronic device (e.g., 100 of FIG. 23), the output sound may be reflected and amplified by the rectangular coupling part 600. For example, the reflected sound may exit the supporting structure 330 and be reflected by the inner wall surface of the receiving part (e.g., 520 of FIG. 23) of the packaging box body (e.g., 510 of FIG. 23). As such, the sound may be amplified while traveling along the shape or space of the coupling part 600. Thus, the rectangular coupling part 600 may facilitate to amplify the sound from the speaker (e.g., 100*b* of FIG. 24).

Figure 26:
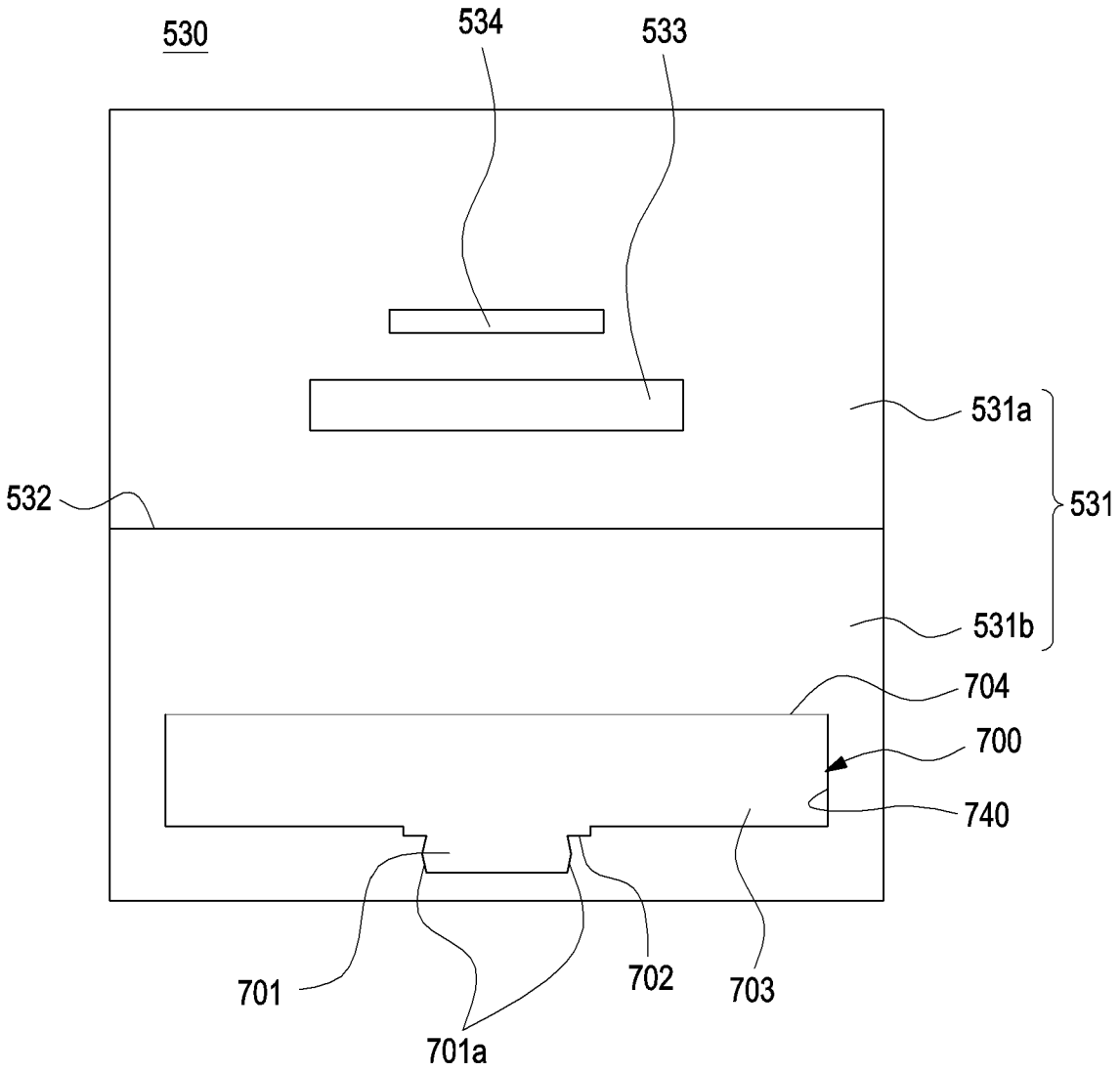
FIG. 26 is a plan view illustrating another example coupling part among components of a supporting structure according to yet other various embodiments of the disclosure.

FIG. 26 is a plan view illustrating another example coupling part among components of a supporting structure according to yet other various embodiments of the disclosure.

Referring to FIG. 26, the coupling part 700 may include a coupling member 701 coupled to or removed from a second coupling hole 534 included in the supporting structure 530 and anti-escaping members 701*a* may be formed on both sides of the coupling member 701 to prevent the coupling member from escaping off the second coupling hole 534 when coupled to the second coupling hole 534. A support 702 may be included on the bottom of the anti-escaping members 701*a* to support the coupling member 701 coupled to the second coupling hole 534, and a connection part 703 may be included between the support 702 and the rotation part 704 to connect the support 702 with the rotation part 704. For example, in the coupling part 700, the connection part 703 may be formed to be larger than at least one support 702. The coupling part 700 may be removed or coupled, as rotated, from the cut portion 740 formed in a second portion 531*b* included in the supporting structure 530.

Thus, the connection part 703 may be formed to be larger than the support 702 to support the coupling part 700 to be rotated from the cut portion 740 of the second portion 531*b*.

As such, as the connection part 703 is formed to be larger than the at least one support 702, the connection part 703 may support and facilitate rotation of the coupling part 700.

Figure 27:
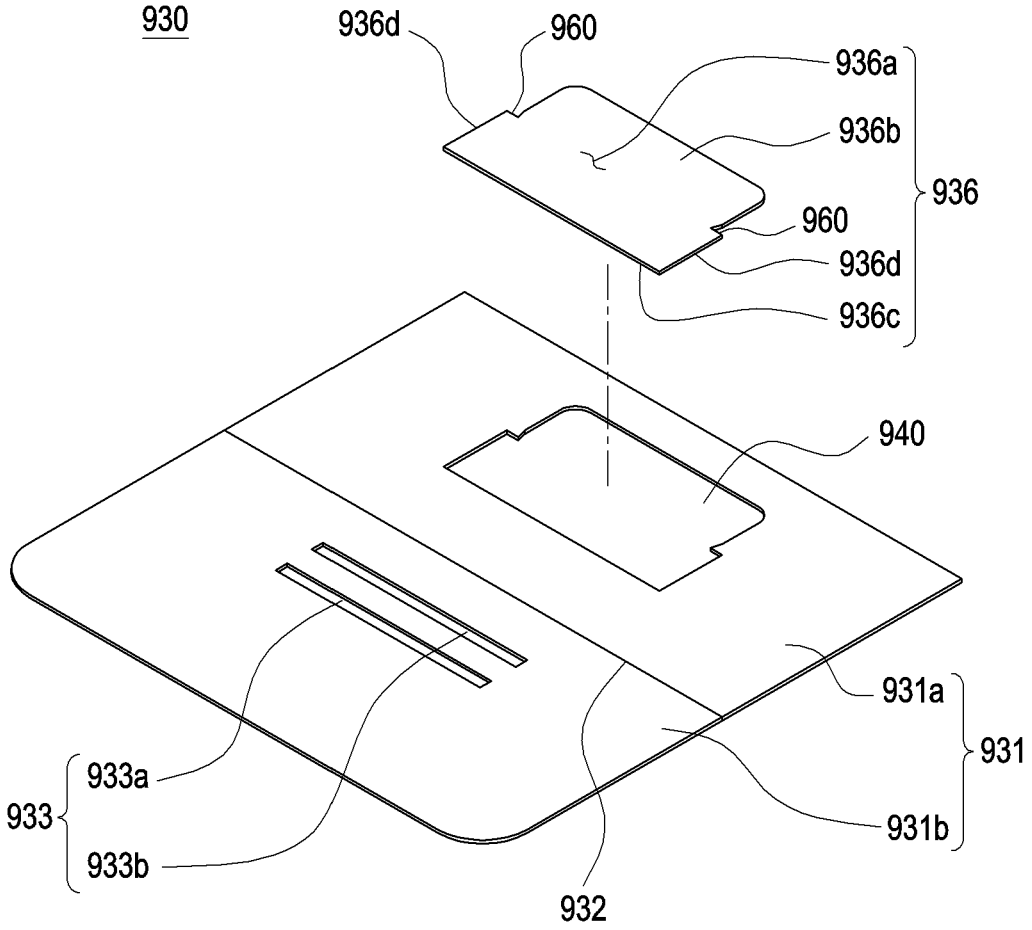
FIG. 27 is an exploded perspective view illustrating a configuration of a supporting structure included in a packaging box of an electronic device, with a speaker positioned on a side surface/back surface, according to yet other various embodiments of the disclosure.
Figure 28:
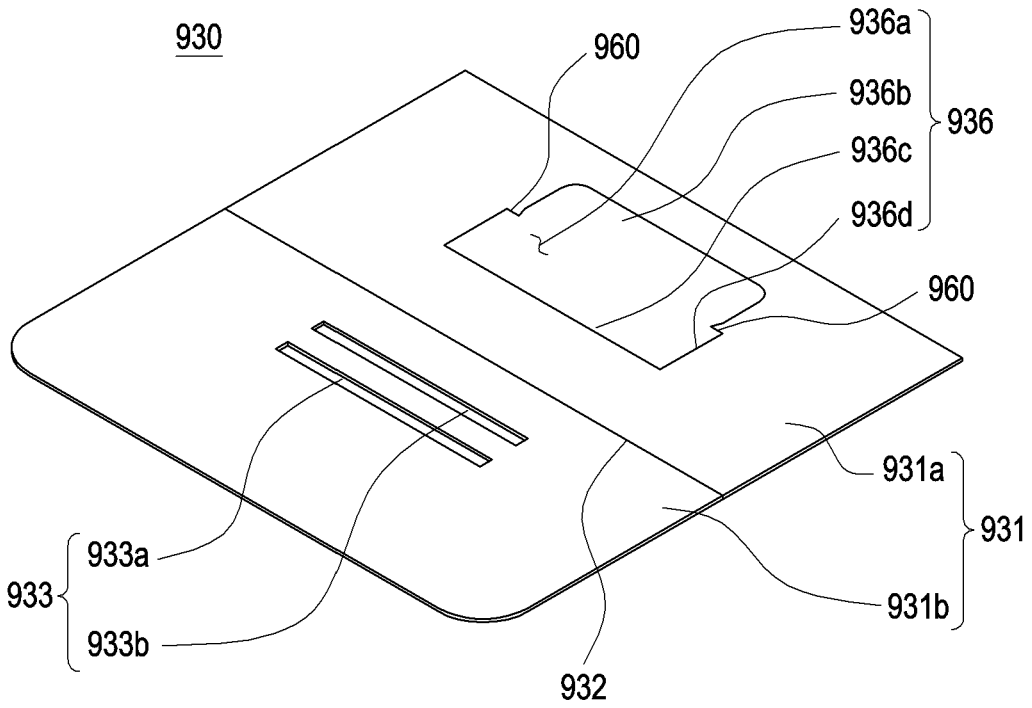
FIG. 28 is a perspective view illustrating a combined state of a supporting structure included in a packaging box of an electronic device, with a speaker positioned on a side surface/back surface, according to yet other various embodiments of the disclosure.

FIG. 27 is an exploded perspective view illustrating a configuration of a supporting structure included in a packaging box of an electronic device (e.g., 100 of FIG. 32), with a speaker (e.g., 100*a* of FIG. 32) positioned on a side surface/back surface, according to yet other various embodiments of the disclosure. FIG. 28 is a perspective view illustrating a combined state of a supporting structure included in a packaging box of an electronic device (e.g., 100 of FIG. 32), with a speaker (e.g., 100*a* of FIG. 32) positioned on a side surface/back surface, according to yet other various embodiments of the disclosure.

Referring to FIGS. 27 and 28, according to various embodiments, a packaging box (e.g., 900 of FIG. 36) of an electronic device (e.g., 100 of FIG. 36) may include a packaging box body (e.g., 910 of FIG. 32), a rotation part 920, and/or a supporting structure 930. For example, the packaging box (e.g., 900 of FIG. 36) may be the same or similar in at least partial configuration to the above-described packaging box (e.g., 300 of FIG. 13). Thus, since the packaging box body (e.g., 910 of FIG. 36) and the receiving part (e.g., 920 of FIG. 36) among the components of the packaging box (e.g., 900 of FIG. 36) may easily be appreciated from the above-described embodiments, no detailed description thereof is given below.

Figure 36:
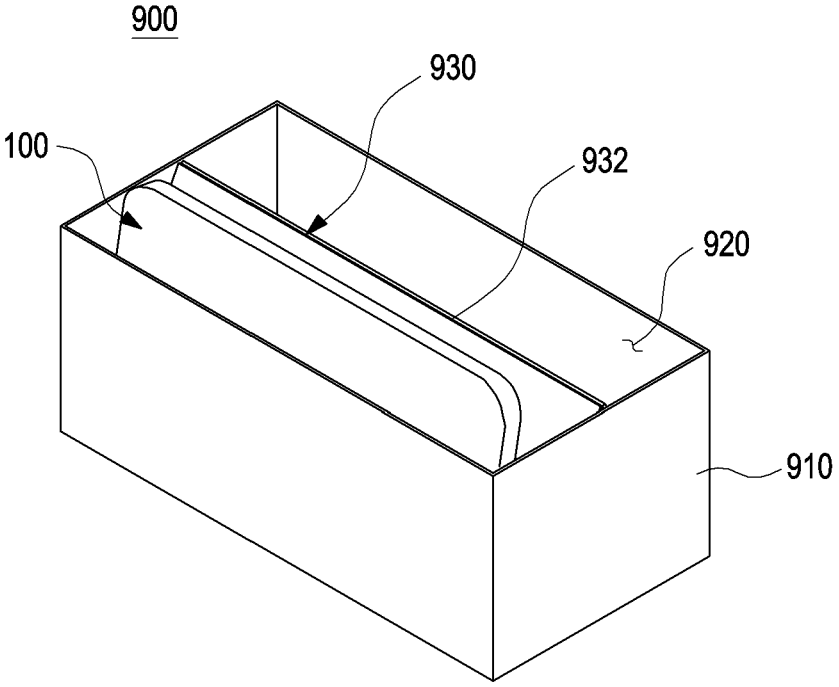
FIG. 36 is a perspective view illustrating a state in which a supporting structure is received in a packaging box, with a coupling member coupled to a second coupling hole among components of a supporting structure included in a packaging box of an electronic device, with a speaker positioned on a side surface/back surface, according to yet other various embodiments of the disclosure.

As described above in connection with FIGS. 27 and 28, the supporting structure 930 may be coupled to the receiving part (e.g., 920 of FIG. 36) to be folded or unfolded to amplify the sound from the speaker (e.g., 100*a* of FIG. 32) included in the electronic device (e.g., 100 of FIG. 36) or to cradle the electronic device (e.g., 100 of FIG. 36). The speaker (e.g., 100*a* of FIG. 32) may be positioned on a side surface/back surface of the electronic device (e.g., 100 of FIG. 36) or on the bottom of the electronic device (e.g., 100 of FIG. 36). In the instant embodiment described, the speaker (e.g., 100*a* of FIG. 32) is positioned on a side surface/back surface of the electronic device (e.g., 100 of FIG. 36).

According to an embodiment, the supporting structure 930 may include a supporting structure body 931, a folding part 932, at least one coupling hole 933, and a coupling part 936. The supporting structure body 931 may be divided into a first portion 931*a* and a second portion 931*b* by the folding part 932 described below. The folding part 932 may be formed between the first portion 931*a* and the second portion 931*b* to be folded and unfolded as the first portion 931*a* and the second portion 931*b* are rotated. The at least one coupling hole 933 may include a first coupling hole 933*a* or a second coupling hole 933*b*. The first coupling hole 933*a* or the second coupling hole 933*b* may be coupled to the coupling part 936 to be able to adjust the folding angle between the first portion 931*a* and the second portion 931*b*. For example, as the coupling member 936*b* is selectively coupled to at least one of the first coupling hole 933*a* or the second coupling hole 933*b*, the folding angle between the first portion 931*a* and the second portion 931*b* may be adjusted.

The coupling part 936 may be coupled to or removed from the cut portion 940 formed in at least a portion of the first portion 931*a*. For example, the coupling part 936 may be rotated by the rotation part 936*c* described below to be thus removed from the cut portion 940 and, as the coupling member 936*b* of the coupling part 936 is rotated as well, the security module 936*b* may simultaneously be coupled to the first coupling hole 933*a*.

As described above in connection with FIGS. 27 and 28, the coupling part 936 may include a coupling body 936*a*, a coupling member 936*b*, a rotation part 936*c*, and/or a support 936*d*. For example, the coupling body 936*a* may include the coupling member 936*b*, the rotation part 936*c*, and the support 936*d* described below. As rotated, the coupling member 936*b* may be coupled to the cut portion 940. The rotation part 936*c* may be formed in at least a portion of the first portion 931*a* and, as rotated, couple the coupling member 936*b* to the cut portion 940. For example, when the coupling member 936*b* is coupled to the first coupling hole 933*a*, an end of the coupling member 936*b* may be projected a predetermined length from the first coupling hole 933*a*, and the rotation part 936*c* may be formed in the other end of the coupling member 936*b* to rotate the coupling member 936*b*. In this case, at least one latching jaw 960 may be formed in the coupling member 936*b* to prevent it from escaping off while being simultaneously projected the predetermined length from the first coupling hole 933*a*. If the coupling member 936*b* is coupled to the first coupling hole 933*a*, the at least one latching jaw 960 may be projected the predetermined length from the first coupling hole 933*a* and be simultaneously stuck to the first coupling hole 933*a* and thus prevented from escaping off the first coupling hole 933*a*. Thus, the coupling member 936*b* may be prevented from escaping off the first coupling hole 933*a* by the at least one latching jaw 960.

A support 936*d* may be included on the bottom surface of the coupling member 936*b* to support the coupling member 936*b*. The support 936*d* may have a rectangular shape.

Figure 29:
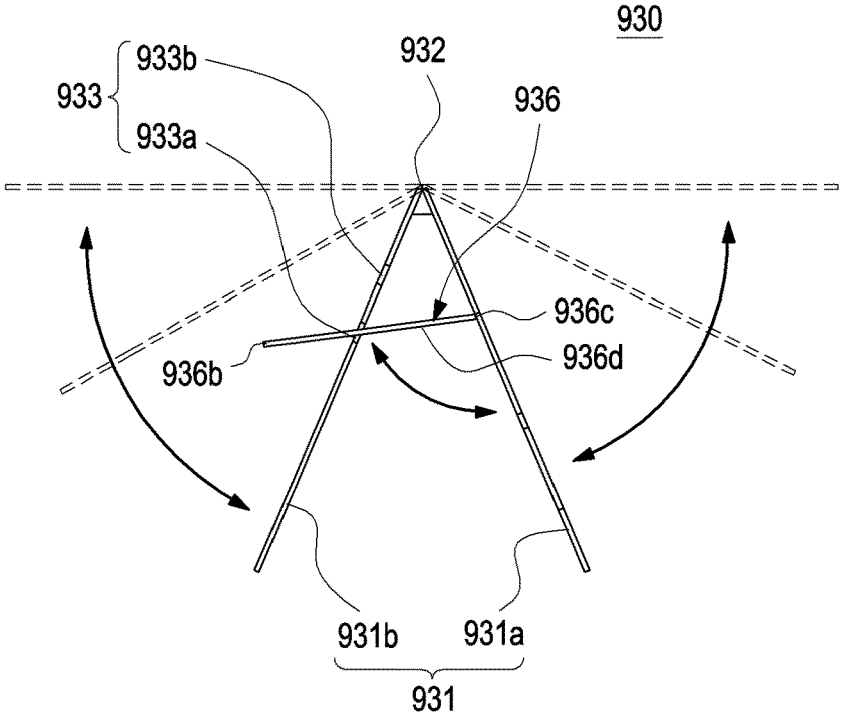
FIG. 29 is a side view illustrating a process in which a coupling member is coupled to a first coupling hole among components of a supporting structure included in a packaging box of an electronic device, with a speaker positioned on a side surface/back surface, according to yet other various embodiments of the disclosure.
Figure 30:
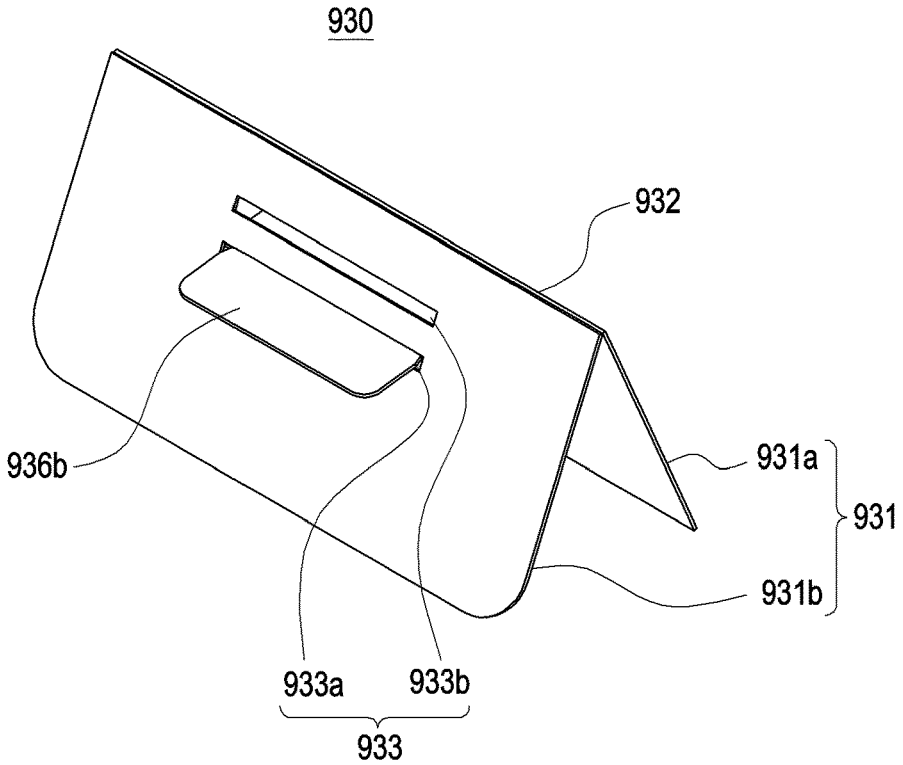
FIG. 30 is a perspective view illustrating a state in which a coupling member is coupled to a first coupling hole among components of a supporting structure included in a packaging box of an electronic device, with a speaker positioned on a side surface/back surface, according to yet other various embodiments of the disclosure.

FIG. 29 is a side view illustrating a process in which a coupling member 936*b* is coupled to a first coupling hole 933*a* among components of a supporting structure included in a packaging box (e.g., 900 of FIG. 36) of an electronic device (e.g., 100 of FIG. 32), with a speaker (e.g., 100*a* of FIG. 32) positioned on a side surface/back surface, according to yet other various embodiments of the disclosure. FIG. 30 is a perspective view illustrating a state in which a coupling member 936*b* is coupled to a first coupling hole 933*a* among components of a supporting structure included in a packaging box of an electronic device (e.g., 100 of FIG. 32), with a speaker (e.g., 100*a* of FIG. 32) positioned on a side surface/back surface, according to yet other various embodiments of the disclosure.

Referring to FIGS. 29 and 30, the first portion 931*a* and the second portion 931*b* may be folded, around the folding part 932 formed between the first portion 931*a* and the second portion 931*b*, into a position slanted from each other. In this case, the coupling member 936*b* of the coupling part 936 formed in at least a portion of the first portion 931*a* may be rotated by the rotation part 936*c* to be coupled to the first coupling hole 933*a*. Simultaneously, at least one latching jaw 960 of the coupling member 936*b* may be stuck to the first coupling hole 933*a*, preventing the coupling member 936*b* from escaping off the first coupling hole 933*a*. The at least one latching jaw 960 may be stuck to the first coupling hole 933*a* while simultaneously allowing the coupling member 936*b* to project a predetermined length from the first coupling hole 933*a*.

According to an embodiment, the first and second portions 931*a* and 931*b* may be formed to be slanted in triangle and, as the coupling member 936*b* is coupled to the first coupling hole 933*a*, the tilt angles at which the first and second portions 931*a* and 931*b* are folded may simultaneously be adjusted.

Figure 31:
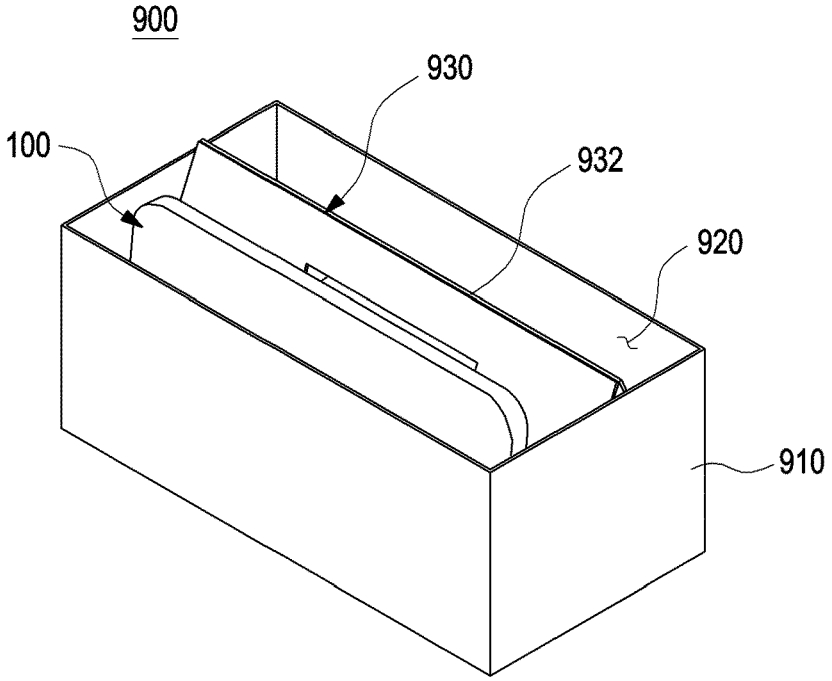
FIG. 31 is a perspective view illustrating a state in which a supporting structure is received in a packaging box, with a coupling member coupled to a first coupling hole among components of a supporting structure included in a packaging box of an electronic device, with a speaker positioned on a side surface/back surface, according to yet other various embodiments of the disclosure.
Figure 32:
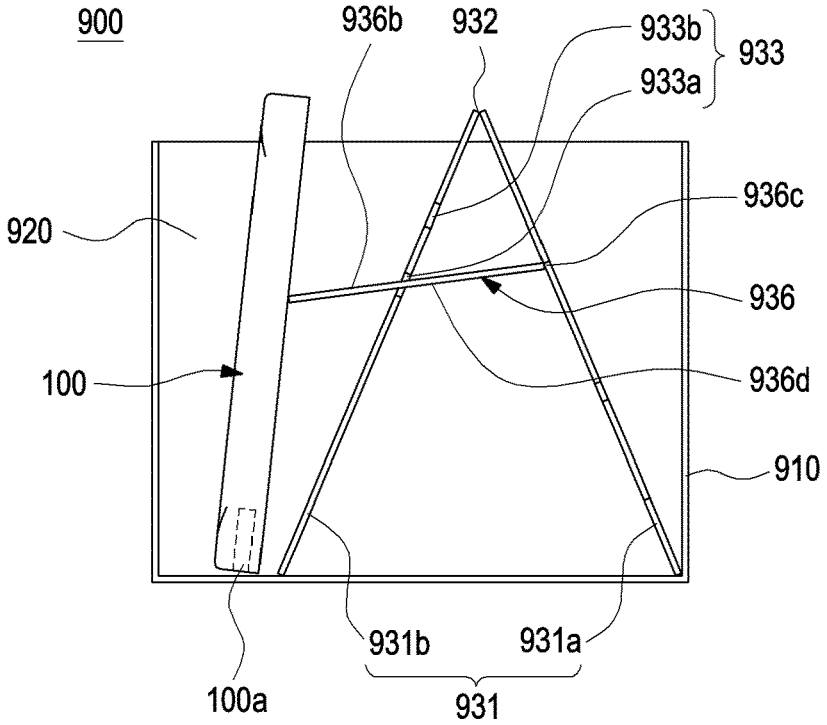
FIG. 32 is a side cross-sectional view illustrating a state in which a supporting structure is received in a packaging box, with a coupling member coupled to a first coupling hole among components of a supporting structure included in a packaging box of an electronic device, with a speaker positioned on a side surface/back surface, according to yet other various embodiments of the disclosure.

FIG. 31 is a perspective view illustrating a state in which a supporting structure 930 is received in a packaging box 900, with a coupling member coupled to a first coupling hole among components of a supporting structure included in a packaging box 900 of an electronic device 100, with a speaker (e.g., 100*a* of FIG. 32) positioned on a side surface/back surface, according to yet other various embodiments of the disclosure. FIG. 32 is a side cross-sectional view illustrating a state in which a supporting structure 930 is received in a packaging box 900, with a coupling member coupled to a first coupling hole among components of a supporting structure included in a packaging box of an electronic device, with a speaker 100*a* positioned on a side surface/back surface, according to yet other various embodiments of the disclosure.

Referring to FIGS. 31 and 32, the supporting structure 930 whose folding angle has been adjusted may be received in the receiving part 920 of the packaging box body 910 to amplify the sound from the speaker 100*a* positioned on the side surface/back surface of the electronic device 100. The folded supporting structure 930 may be received in the length direction of the packaging box body 910 and support the electronic device 100, which is erected in the length direction, in a position tilted backward. The supporting structure 930 may support the electronic device 100 to be received in the receiving part 920 of the packaging box body 910. If a sound is output from the speaker 100*a* positioned on the side surface/back surface of the electronic device 100 in this state, the output sound may be reflected by the inner wall of the packaging box body 910, and the reflected sound may be reflected by the supporting structure 930 or travel along a space formed by the supporting structure 930. As such, the sound may be amplified while traveling along the shape or space of the supporting structure 930.

Figure 33:
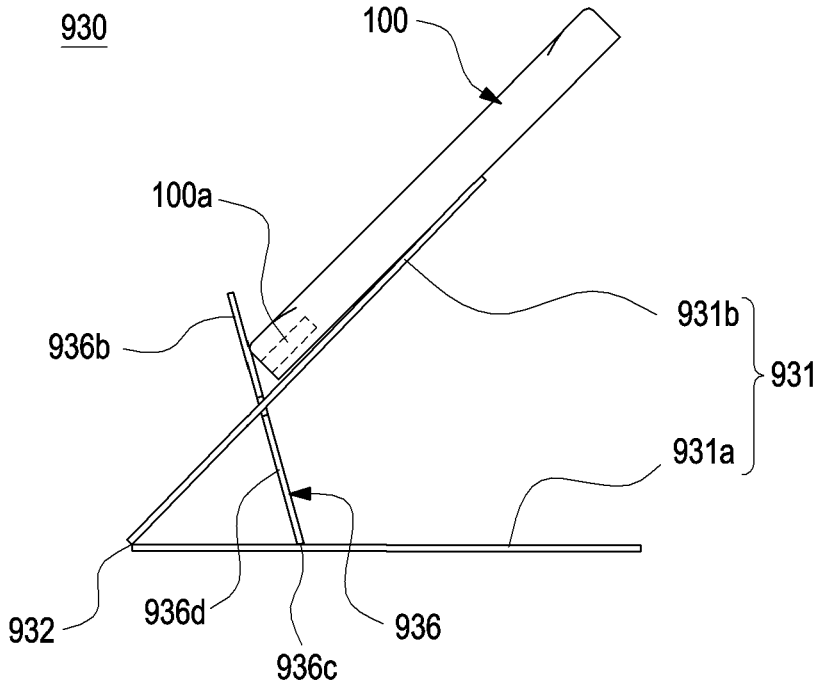
FIG. 33 is a side cross-sectional view illustrating a state in which a coupling member is coupled to a first coupling hole among components of a supporting structure to be used as a cradle, according to yet other various embodiments of the disclosure.

FIG. 33 is a side cross-sectional view illustrating a state in which a coupling member 936*b* is coupled to a first coupling hole 933*a* among components of a supporting structure to be used as a cradle, according to yet other various embodiments of the disclosure.

Referring to FIG. 33, the supporting structure 930 in which the folding angle between the first and second portions 931*a* and 931*b* has been adjusted may be used as a cradle for the electronic device 100. For example, the folded supporting structure 930 may be removed from the receiving part 920 of the packaging box body 910, and the first portion 931*a* may be positioned to face the bottom surface while the second portion 931*b* may be simultaneously formed slantedly. In this case, since in the slanted second portion 931*b*, the coupling member 936*b* of the coupling part 936 projects a predetermined length, the electronic device 100 may be placed and cradled on the coupling member 936*b*.

Since the folded supporting structure 930 may be used as a cradle for the electronic device 100 if removed from the receiving part 920, the user may listen to music or watch video via the electronic device 100 cradled on the supporting structure 930.

As such, the packaging box 900 may be used to cradle the electronic device 100, as well as to amplify the sound from the speaker 100*a* positioned on the side surface/back surface of the electronic device 100 using the supporting structure 930 which adjusts the folding angle between the first and second portions 931*a* and 931*b*.

Figure 34:
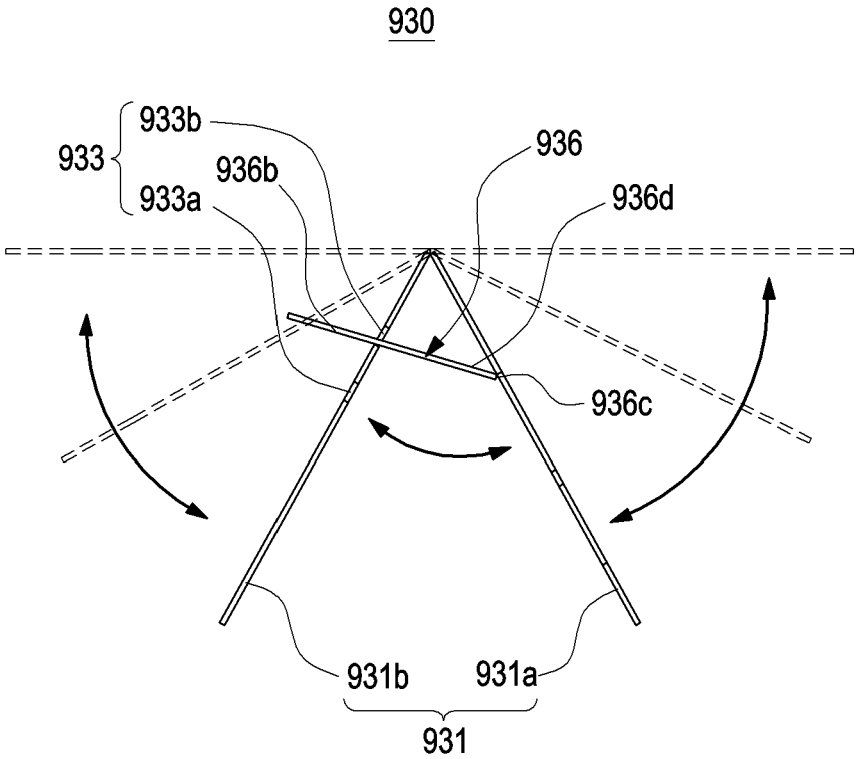
FIG. 34 is a side view illustrating a process in which a coupling member is coupled to a second coupling hole among components of a supporting structure included in a packaging box of an electronic device, with a speaker positioned on a side surface/back surface, according to yet other various embodiments of the disclosure.
Figure 35:
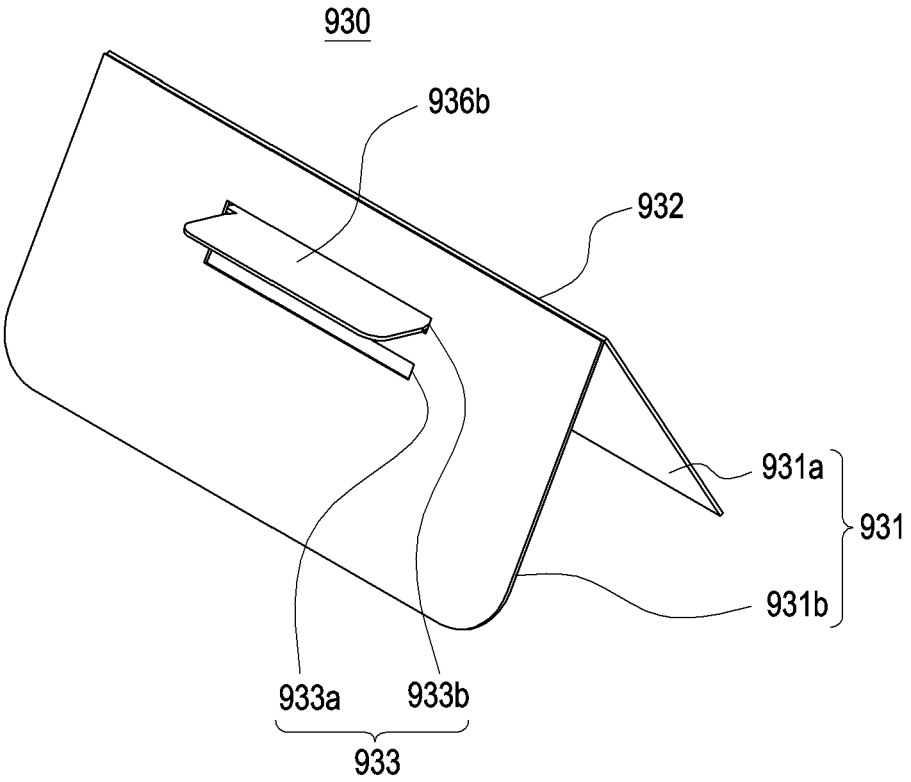
FIG. 35 is a perspective view illustrating a state in which a coupling member is coupled to a second coupling hole among components of a supporting structure included in a packaging box of an electronic device, with a speaker positioned on a side surface/back surface, according to yet other various embodiments of the disclosure.

FIG. 34 is a side view illustrating a process in which a coupling member 936*b* is coupled to a second coupling hole 933*b* among components of a supporting structure 930 included in a packaging box of an electronic device (e.g., 100 of FIG. 36), with a speaker (e.g., 100*a* of FIG. 32) positioned on a side surface/back surface, according to yet other various embodiments of the disclosure. FIG. 35 is a perspective view illustrating a state in which a coupling member 936*b* is coupled to a second coupling hole 933*b* among components of a supporting structure 930 included in a packaging box of an electronic device (e.g., 100 of FIG. 36), with a speaker (e.g., 100*a* of FIG. 32) positioned on a side surface/back surface, according to yet other various embodiments of the disclosure.

Referring to FIGS. 34 and 35, the first portion 931*a* and the second portion 931*b* may be rotated and folded, around the folding part 932 formed between the first portion 931*a* and the second portion 931*b*, into a position slanted from each other. In this case, the coupling member 936*b* of the coupling part 936 formed in at least a portion of the first portion 931*a* may be rotated by the rotation part 936*c* to be coupled to the second coupling hole 933*b*. Simultaneously, at least one latching jaw 960 of the coupling part 936 may be stuck to the first coupling hole 933*a*, preventing the coupling part 936 from escaping off the second coupling hole 933*b*. The at least one latching jaw 960 may be stuck to the second coupling hole 933*b* while simultaneously allowing the coupling member 936*b* to project a predetermined length from the second coupling hole 933*b*.

In this case, the first and second portions 931*a* and 931*b* may be formed to be slanted in triangle and, as the coupling member 936*b* of the coupling part 936 is coupled to the second coupling hole 933*b*, the tilt angles at which the first and second portions 931*a* and 931*b* are folded may simultaneously be adjusted.

Figure 37:
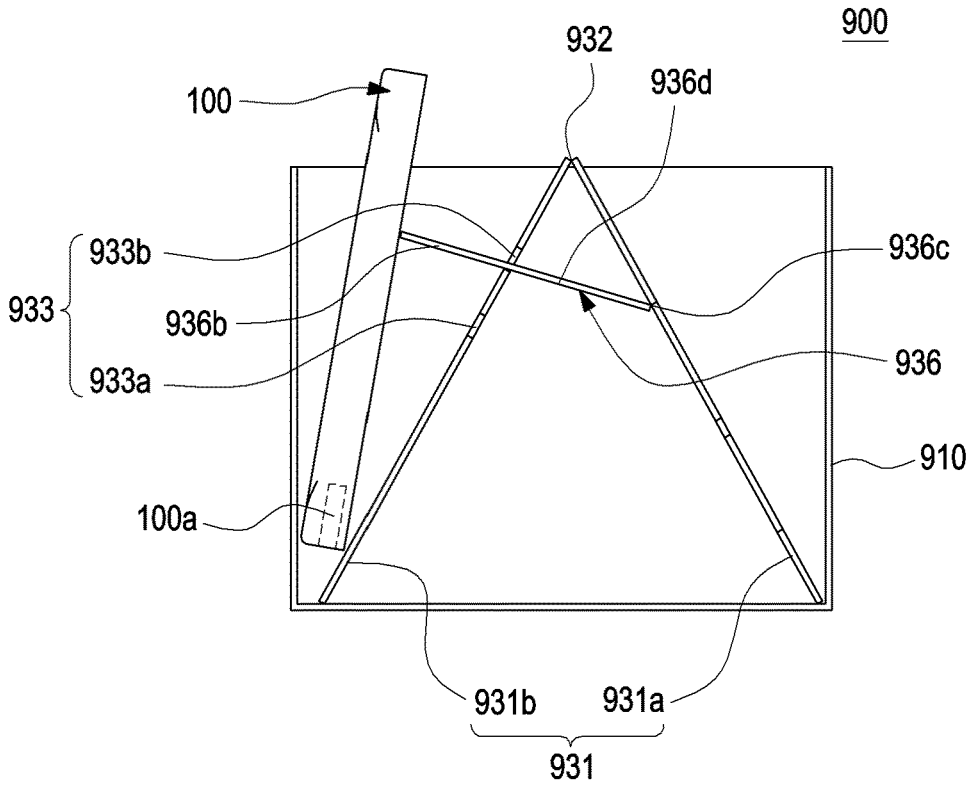
FIG. 37 is a side cross-sectional view illustrating a state in which a supporting structure is received in a packaging box, with a coupling member coupled to a first coupling hole among components of a supporting structure included in a packaging box of an electronic device, with a speaker positioned on a side surface/back surface, according to yet other various embodiments of the disclosure.

FIG. 36 is a perspective view illustrating a state in which a supporting structure 930 is received in a packaging box 900, with a coupling member coupled to a second coupling hole 933*b* among components of a supporting structure 930 included in a packaging box 900 of an electronic device 100, with a speaker positioned on a side surface/back surface, according to yet other various embodiments of the disclosure. FIG. 37 is a side cross-sectional view illustrating a state in which a supporting structure is received in a packaging box 900, with a coupling member 936 coupled to a first coupling hole 933*a* among components of a supporting structure included in a packaging box 900 of an electronic device 100, with a speaker 100*a* positioned on a side surface/back surface, according to yet other various embodiments of the disclosure.

Referring to FIGS. 36 and 37, the supporting structure 930 whose folding angle has been adjusted may be received in the receiving part 920 of the packaging box body 910 to amplify the sound from the speaker 100*a* positioned on the side surface/back surface of the electronic device 100. The folded supporting structure 930 may be received in the length direction of the packaging box body 910 and support the electronic device 100, which is erected in the length direction, in a position tilted backward. The supporting structure 930 may support the electronic device 100 to be received in the receiving part 920 of the packaging box body 910. If a sound is output from the speaker 100*a* positioned on the side surface/back surface of the electronic device 100 in this state, the output sound may be reflected by the inner wall of the packaging box body 910, and the reflected sound may be reflected by the supporting structure 930 or travel along a space formed by the supporting structure 930. As such, the sound may be amplified while traveling along the shape or space of the supporting structure 930.

Figure 38:
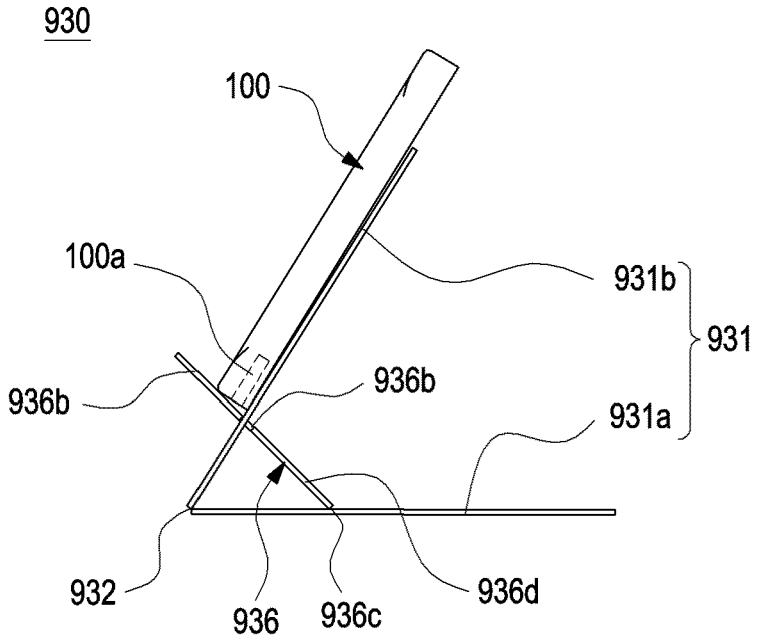
FIG. 38 is a side cross-sectional view illustrating a state in which a coupling member is coupled to a second coupling hole among components of a supporting structure to be used as a cradle, according to yet other various embodiments of the disclosure.

FIG. 38 is a side cross-sectional view illustrating a state in which a coupling member 936*b* is coupled to a second coupling hole 933*b* among components of a supporting structure 930 to be used as a cradle, according to yet other various embodiments of the disclosure.

Referring to FIG. 38, the supporting structure 930 in which the folding angle between the first and second portions 931*a* and 931*b* has been adjusted may be used as a cradle for the electronic device 100. For example, the folded supporting structure 930 may be removed from the receiving part 920 of the packaging box body 910, and the first portion 931*a* may be positioned to face the bottom surface while the second portion 931*b* may be simultaneously formed slantedly. In this case, since in the slanted second portion 931*b*, the coupling member 936*b* of the coupling part 936 projects a predetermined length from the second coupling hole 933*b*, the electronic device 100 may be placed and cradled on the projecting coupling member 936*b*.

Since the folded supporting structure 930 may be used as a cradle for the electronic device 100 if removed from the receiving part 920, the user may listen to music or watch video via the electronic device 100 cradled on the supporting structure 930.

As such, the packaging box 900 may be used to cradle the electronic device 100, as well as to amplify the sound from the speaker 100*a* positioned on the side surface/back surface of the electronic device 100 using the supporting structure 930 which adjusts the folding angle between the first and second portions 931*a* and 931*b*.

According to various embodiments of the disclosure, a packaging box (e.g., 200 of FIG. 7) of an electronic device (e.g., 100 of FIG. 7) comprises a packaging box body (e.g., 210 of FIG. 7), a receiving part (e.g., 220 of FIG. 7) included in the packaging box body and receiving the electronic device, and a supporting structure (e.g., 230 of FIG. 7) received in or removed from the receiving part, a portion of the supporting structure able to be slantedly folded to or unfolded from another portion of the supporting structure. The supporting structure in a folded state may be received, together with the electronic device, in the receiving part to support the electronic device to be able to amplify a sound from a speaker (e.g., 100*a* of FIG. 7) and, in a state removed from the receiving part or in a state received in the receiving part, the supporting structure may cradle the electronic device.

According to various embodiments of the disclosure, the supporting structure may include a supporting structure body (e.g., 231 of FIG. 2) divided into a first portion and a second portion, a folding part (e.g., 232 of FIG. 2) formed between the first portion and the second portion and allowing the first portion and the second portion to be folded or unfolded, a coupling hole (e.g., 233 of FIG. 2) formed in at least a portion of the first portion, and a coupling part (e.g., 234 of FIG. 2) coupled to or removed from the coupling hole as rotated in a cut portion formed in at least a portion of the second portion.

According to various embodiments of the disclosure, the coupling part may include a coupling body (e.g., 234*a* of FIG. 2), a coupling member (e.g., 234*b* of FIG. 2) formed in an end of the coupling body and, as rotated, coupled to or removed from the coupling hole, a rotation part (e.g., 234*c* of FIG. 2) formed in another end of the coupling body and rotating the coupling member, and a support (e.g., 234*d* of FIG. 2) formed between the coupling member and the rotation part to support the coupling member.

According to various embodiments of the disclosure, the coupling member may further include at least one latching jaw (e.g., 260 of FIG. 2) to be stuck to the coupling hole to allow the coupling member to project a predetermined length from the coupling hole.

According to various embodiments of the disclosure, a material of the supporting structure may include at least one of paper, plastic, or wood.

According to various embodiments of the disclosure, the supporting structure may include at least one of a manual box, a container for an accessory of the electronic device, or a partition.

According to various embodiments of the disclosure, the supporting structure (e.g., 330 of FIG. 13) may include a supporting structure body divided into a first portion (e.g., 331*a* of FIG. 10), a second portion (e.g., 331*b* of FIG. 10), and a third portion (e.g., 331*c* of FIG. 10), a first folding part (e.g., 332 of FIG. 10) formed between the first portion and the second portion and allowing the first portion and the second portion to be folded or unfolded, a second folding part (e.g., 333 of FIG. 10) formed between the second portion and the third portion and allowing the second portion and the third portion to be folded or unfolded, a first coupling hole (e.g., 334 of FIG. 10) formed to couple or remove the electronic device to/from at least a portion of the first portion, a second coupling hole (e.g., 335 of FIG. 10) formed in at least a portion of the first portion, and a coupling part (e.g., 336 of FIG. 10) projecting from at least a portion of an outer circumference of the third portion and coupled to or removed from the second coupling hole as the first portion and the third portion rotate.

According to various embodiments of the disclosure, the coupling part may include a coupling body (e.g., 336*a* of FIG. 10) and a coupling member (e.g., 336*b* of FIG. 10) formed in the coupling body and, as the first portion and the third portion rotate, coupled to or removed from the second coupling hole.

According to various embodiments of the disclosure, anti-escaping members (e.g., 370 of FIG. 10) may be slantedly formed in both ends of the coupling member to prevent escape from the second coupling hole.

According to various embodiments of the disclosure, a side width of the first portion, a side width of the second portion, and a side width of the third portion may be identical to or different from one another.

According to various embodiments of the disclosure, the first coupling hole and the second coupling hole may be formed to be close to each other or distant from each other.

According to various embodiments of the disclosure, the supporting structure (e.g., 530 of FIG. 19) may include a supporting structure body divided into a first portion (e.g., 531*a* of FIG. 19) and a second portion (e.g., 531*b* of FIG. 19), a folding part (e.g., 532 of FIG. 19) formed between the first portion and the second portion and allowing the first portion and the second portion to be folded or unfolded, a first coupling hole (e.g., 533 of FIG. 19) formed to couple or remove the electronic device to/from at least a portion of the first portion, a second coupling hole (e.g., 534 of FIG. 19) formed in at least a portion of the first portion and a coupling part (e.g., 536 of FIG. 19) coupled to or removed from the second coupling hole as rotated in a cut portion formed in at least a portion of the second portion.

According to various embodiments of the disclosure, the coupling part may include a coupling body (e.g., 536*a* of FIG. 19), a coupling member (e.g., 536*b* of FIG. 19) formed in the coupling body and, as rotated, coupled to or removed from the second coupling hole, a rotation part (e.g., 536*c* of FIG. 19) formed in another end of the coupling body and rotating the coupling member, and at least one support (e.g., 536*d* of FIG. 19 (included in at least a portion of the coupling body and formed, in a multi-stage structure, between the coupling member and the rotation part to support the coupling member.

According to various embodiments of the disclosure, anti-escaping members (e.g., 570 of FIG. 19) may be slantedly formed in both ends of the coupling member to prevent escape from the second coupling hole. At least one latching jaw may be included on a bottom surface of the anti-escaping members to be stuck to the second coupling hole to allow the coupling member to project a predetermined length from the second coupling hole. A connection part (e.g., 590 of FIG. 19) may be formed between the rotation part and the at least one latching jaw and may connect the rotation part with the at least one latching jaw (e.g., 580 of FIG. 19).

According to various embodiments of the disclosure, the coupling part may be formed in a step shape.

According to various embodiments of the disclosure, the coupling part may be shaped as a rectangle.

According to various embodiments of the disclosure, in the coupling part, the connection part may be formed to be larger than the at least one support.

According to various embodiments of the disclosure, the supporting structure (e.g., 930 of FIG. 27) may include a supporting structure body (e.g., 931 of FIG. 27) divided into a first portion and a second portion, a foldin part (e.g., 932 of FIG. 27) formed between the first portion and the second portion and allowing the first portion and the second portion to be folded or unfolded, at least one coupling hole (e.g., 933 of FIG. 27) formed in at least a portion of the second portion, and a coupling part (e.g., 936 of FIG. 27) coupled to or removed from the at least one coupling hole as rotated in a cut portion formed in at least a portion of the first portion.

According to various embodiments of the disclosure, the coupling part may include a coupling body (e.g., 936*a* of FIG. 27), a coupling member (e.g., 936*b* of FIG. 27) formed in an end of the coupling body and, as rotated, coupled to or removed from the at least one coupling hole, a rotation part (e.g., 936*c* of FIG. 27) formed in another end of the coupling body and rotating the coupling member, and a support (e.g., 936*d* of FIG. 27) formed between the coupling member and the rotation part to support the coupling member.

According to various embodiments of the disclosure, the coupling member may further include at least one latching jaw (e.g., 960 of FIG. 27) to be stuck to the at least one coupling hole to allow the coupling member to project a predetermined length from the at least one coupling hole.

According to various embodiments of the disclosure, the at least one coupling hole may include a first coupling hole and a second coupling hole. The first and second coupling holes may be coupled with the coupling member to adjust the folding angle between the first portion and the second portion.

According to various embodiments of the disclosure, a packaging box of an electronic device comprises a packaging box body, a receiving part included in the packaging box body and receiving the electronic device, and a supporting structure received in or removed from the receiving part and foldable or unfoldable. When the supporting structure in a folded state is received, together with the electronic device, in the receiving part, the supporting structure may amplify a sound from a speaker included in the electronic device and, in a state removed from the receiving part or in a state received in the receiving part, the supporting structure may cradle the electronic device.

It is apparent to one of ordinary skill in the art that the electronic devices with an antenna device according to various embodiments of the disclosure as described above are not limited to the above-described embodiments and those shown in the drawings, and various changes, modifications, or alterations may be made thereto without departing from the scope of the disclosure.

What is claimed is:

1. A packaging box of an electronic device, comprising:
- a packaging box body including an inner wall;
- a receiving part included in the packaging box body and receiving the electronic device; and
- a supporting structure received in or removed from the receiving part, at least a portion of the supporting structure able to be slantedly folded to or unfolded,
- wherein the supporting structure in a folded state is received, together with the electronic device, in the receiving part to support the electronic device to be able to amplify a sound from a speaker included in the electronic device,
- wherein the supporting structure cradles the electronic device in both a state removed from the receiving part and a state received in the receiving part,
- wherein the supporting structure includes:
  - a coupling hole formed in a first portion of the supporting structure, and
  - a coupling part formed in a second portion of the supporting structure and coupled to or removed from the coupling hole,
- wherein in a state in which the electronic device is received in the receiving part, the speaker included in the electronic device is disposed adjacent to the inner wall of the packaging box body, the speaker and a peripheral part of the speaker are sealed by the inner wall, and
- wherein the sound from the speaker included in the electronic device is amplified by reflection on the inner wall of the packaging box body and the supporting structure.

2. The packaging box of claim 1, wherein the supporting structure includes:
- a supporting structure body divided into the first portion and the second portion;
- a folding part formed between the first portion and the second portion and allowing the first portion and the second portion to be folded or unfolded;
- the coupling hole formed in at least a portion of the first portion; and
- the coupling part coupled to or removed from the coupling hole as rotated in a cut portion formed in at least a portion of the second portion.

3. The packaging box of claim 2,
- wherein the coupling part includes:
  - a coupling body;
  - a coupling member formed in an end of the coupling body, and as rotated, coupled to or removed from the coupling hole;
  - a rotation part formed in another end of the coupling body, connected to the second portion, and rotating the coupling member; and
  - a support included in at least a portion of the coupling body and formed between the coupling member and the rotation part to support the coupling member, and
- wherein the coupling member further includes at least one latching jaw to be stuck to the coupling hole.

4. The packaging box of claim 1,
- wherein a material of the supporting structure includes at least one of paper, plastic, or wood, and wherein the supporting structure includes at least one of a manual box, a container for an accessory of the electronic device, or a partition.

5. The packaging box of claim 1, wherein the supporting structure includes:

a supporting structure body divided into the first portion, the second portion, and a third portion;

a first folding part formed between the first portion and the second portion and allowing the first portion and the second portion to be folded or unfolded;

a second folding part formed between the second portion and the third portion and allowing the second portion and the third portion to be folded or unfolded;

a through hole formed to couple the electronic device to or remove the electronic device from at least a portion of the first portion;

the coupling hole formed in at least a portion of the first portion; and the coupling part projecting from at least a portion of an outer circumference of the third portion and coupled to or removed from the coupling hole as the first portion and the third portion rotate.

6. The packaging box of claim 5, wherein the coupling part includes:

a coupling body; and a coupling member formed in the coupling body, and as the first portion and the third portion rotate, coupled to or removed from the coupling hole, and wherein anti-escaping members slantedly formed in both ends of the coupling member to prevent escape from the coupling hole.

7. The packaging box of claim 5, wherein a side width of the first portion, a side width of the second portion, and a side width of the third portion are identical to or different from one another.

8. The packaging box of claim 5, wherein the through hole and the coupling hole are formed to be close to each other or distant from each other.

9. The packaging box of claim 1, wherein the supporting structure includes:

a supporting structure body divided into a first portion and a second portion;

a folding part formed between the first portion and the second portion and allowing the first portion and the second portion to be folded or unfolded;

a through hole formed to couple the electronic device to or remove the electronic device from at least a portion of the first portion;

the coupling hole formed in at least a portion of the first portion; and the coupling part coupled to or removed from the coupling hole as rotated in a cut portion formed in at least a portion of the second portion.

10. The packaging box of claim 9, wherein the coupling part includes:

a coupling body;

a coupling member formed in the coupling body, and as rotated, coupled to or removed from the coupling hole;

a rotation part formed in another end of the coupling body and rotating the coupling member; and at least one support included in at least a portion of the coupling body and formed, in a multi-stage structure, between the coupling member and the rotation part to support the coupling member, wherein anti-escaping members are slantedly formed in both ends of the coupling member to prevent escape from the coupling hole, wherein at least one latching jaw is included on a bottom surface of the anti-escaping members to be stuck to the coupling hole, and wherein a connection part is formed between the rotation part and the at least one latching jaw and connects the rotation part with the at least one latching jaw.

11. The packaging box of claim 10, wherein the coupling part is formed in a step shape, wherein the coupling part is shaped as a rectangle, and wherein the connection part is formed to be larger than the at least one support.

12. The packaging box of claim 1, wherein the supporting structure includes:

a supporting structure body divided into the first portion and the second portion;

a folding part formed between the first portion and the second portion and allowing the first portion and the second portion to be folded or unfolded;

the coupling hole formed in at least a portion of the second portion; and the coupling part coupled to or removed from the coupling hole as rotated in a cut portion formed in at least a portion of the first portion.

13. The packaging box of claim 12, wherein the coupling part includes:

a coupling body;

a coupling member formed in an end of the coupling body, and as rotated, coupled to or removed from the coupling hole;

a rotation part formed in another end of the coupling body and rotating the coupling member; and a support included in at least a portion of the coupling body and formed between the coupling member and the rotation part to support the coupling member.

14. The packaging box of claim 13, wherein the coupling hole includes a first coupling hole and a second coupling hole, and wherein as the coupling member is selectively coupled to one of the first coupling hole and the second coupling hole, a folding angle between the first portion and the second portion is adjusted.

15. The packaging box of claim 1, wherein the supporting structure is able to be folded or unfolded, wherein when the supporting structure in a folded state is received, together with the electronic device, in the receiving part, the supporting structure amplifies the sound from the speaker included in the electronic device, and wherein, in a state removed from the receiving part and in a state received in the receiving part, the supporting structure cradles the electronic device.

* * * * *